US009027580B2

(12) United States Patent
Di Cesare

(10) Patent No.: US 9,027,580 B2
(45) Date of Patent: May 12, 2015

(54) RIB STRUCTURE OF UMBRELLAS

(76) Inventor: John David Di Cesare, Saitama (JP)

( * ) Notice: Subject to any disclaimer, the term of this patent is extended or adjusted under 35 U.S.C. 154(b) by 468 days.

(21) Appl. No.: 13/306,208

(22) Filed: Nov. 29, 2011

(65) Prior Publication Data

US 2012/0298159 A1 Nov. 29, 2012

(30) Foreign Application Priority Data

Dec. 2, 2010 (JP) ..... 2010-007884

(51) Int. Cl.

| | |
|---|---|
| ***A45B 11/00*** | (2006.01) |
| ***A45B 25/02*** | (2006.01) |
| ***A45B 25/18*** | (2006.01) |
| ***A45B 25/06*** | (2006.01) |
| ***A45B 25/10*** | (2006.01) |
| ***A45B 25/22*** | (2006.01) |

(52) U.S. Cl.

CPC ..... *A45B 11/00* (2013.01); *A45B 25/02* (2013.01); *A45B 25/06* (2013.01); *A45B 25/10* (2013.01); *A45B 25/18* (2013.01); *A45B 25/22* (2013.01); *A45B 2011/005* (2013.01)

(58) Field of Classification Search

CPC .. A45B 23/00; A45B 2011/005; A45B 17/00; A45B 11/00

USPC ..... 135/15.1, 20.1

See application file for complete search history.

(56) References Cited

U.S. PATENT DOCUMENTS

| | | | | | |
|---|---|---|---|---|---|
| 2,654,380 | A * | 10/1953 | Eichenbaum | ..... | 135/33.2 |
| 2,707,476 | A * | 5/1955 | Clemens | ..... | 135/20.1 |
| 2,948,289 | A * | 8/1960 | Owczarek | ..... | 135/20.1 |
| 3,042,055 | A * | 7/1962 | Todorovic | ..... | 135/20.1 |
| 4,474,200 | A * | 10/1984 | Kida | ..... | 135/26 |
| 5,505,221 | A * | 4/1996 | Gao | ..... | 135/20.1 |
| D503,036 | S * | 3/2005 | Di Cesare | ..... | D3/5 |
| 7,350,530 | B2 * | 4/2008 | Lisciandro et al. | ..... | 135/20.1 |
| 7,401,618 | B2 * | 7/2008 | Caldwell | ..... | 135/33.7 |
| 7,610,925 | B2 * | 11/2009 | Parisi | ..... | 135/20.1 |
| 7,665,476 | B2 * | 2/2010 | Lisciandro et al. | ..... | 135/20.1 |
| 2006/0070644 | A1 * | 4/2006 | Schneller | ..... | 135/20.1 |
| 2006/0090781 | A1 * | 5/2006 | Lisciandro et al. | ..... | 135/20.1 |
| 2008/0066793 | A1 * | 3/2008 | Ma | ..... | 135/28 |
| 2008/0149152 | A1 * | 6/2008 | Huang | ..... | 135/20.1 |
| 2008/0163911 | A1 * | 7/2008 | Lisciandro et al. | ..... | 135/20.1 |
| 2009/0126769 | A1 * | 5/2009 | Hoogendoorn | ..... | 135/98 |
| 2009/0308419 | A1 * | 12/2009 | You | ..... | 135/20.1 |
| 2011/0108074 | A1 * | 5/2011 | You | ..... | 135/20.1 |
| 2012/0111381 | A1 * | 5/2012 | Solotoff | ..... | 135/20.1 |

FOREIGN PATENT DOCUMENTS

| | | | |
|---|---|---|---|
| EP | 2460432 | A2 * | 6/2012 |
| WO | WO 2005023042 | A1 * | 3/2005 |

* cited by examiner

*Primary Examiner* — David R Dunn
*Assistant Examiner* — Danielle Jackson
(74) *Attorney, Agent, or Firm* — Lucas & Mercanti, LLP

(57) ABSTRACT

In order to provide a rib structure of an umbrella, which has superior appearance without receiving unnecessary structural pressure and can contribute to the development of the industry by motivating consumers to buy, this invention features the rib structure of an umbrella which is formed with multiple ribs wherein the length of specific ribs is different from the length of other specific ribs, cloth is stretched onto the above mentioned ribs thereby changing forms of the umbrella and when the above mentioned cloth is put between the above mentioned ribs and adjacent ribs, the cloth does not expand and contract in the direction of the length of said ribs, but is expandable and contractible in any direction with the exception of the direction of the length of said ribs.

11 Claims, 31 Drawing Sheets

RIB STRUCTURE OF UMBRELLAS

BACKGROUND OF THE INVENTION

1. Field of the Invention

The present invention relates to a rib structure of umbrellas and more specifically to umbrellas featured by shapes formed by ribs and cloth which is stretched over the ribs.

2. Description of the Prior Arts

Traditionally, various designs have been drawn on rain sealed cloth for use on parasols and umbrellas. Also, various forms of umbrellas, such as stick and folding umbrellas used for protection from the rain, have the characteristic of being easy to carry.

Umbrellas of western style are disclosed in Japanese published patent application (Tokukai) 2003-153717 which can absorb shock by spinning around the shaft of the umbrella to avoid breakage when subjected to external forces such as strong wind.

Conventional umbrellas, however, have problems as described below.

In the prior art umbrellas, the cloth is stretched in a circle around the shaft, with various designs drawn on the cloth and the forms of the umbrellas are quite commonplace and the designs are usually somewhat ordinary. Therefore those umbrellas are not fashionable and provide consumers with little motivation to buy.

In this respect, the umbrella stated in the aforementioned Japanese published patent application is the same. It does not sufficiently attract and motivate consumers to buy.

In this situation, there may have been various attempts to produce umbrellas of various forms but it has been difficult to make umbrellas of such desirable forms. These forms have not been achieved up to now.

SUMMARY OF THE INVENTION

This invention was designed with consideration of the points described above, and the purpose is to provide a rib structure for an umbrella which relieves it of unnecessary structural pressure, has a superior appearance from a fashion standpoint, and can contribute to development of the industry by motivating consumers to buy.

In order to accomplish the object of the invention above mentioned, a rib structure of an umbrella is provided formed with multiple ribs characterized by the length of predetermined ribs being different from the length of other predetermined ribs. Cloth is stretched onto the ribs thereby changing the form of the umbrella wherein the cloth stretched between the adjacent two ribs does not expand and contract in the direction of the length of said ribs, but is expandable and contractible in directions with the exception of the direction of the length of the ribs.

The present invention is characterized in that the above mentioned multiple ribs are connected to the top notch at one of their ends and the range of movement of the specified ribs is wider than the range of movement of other specified ribs in a vertical direction at the connecting position of the above mentioned ribs with the above mentioned top notch.

The present invention is characterized in that the multiple stretchers connect to the above mentioned multiple ribs and a runner, the length of specified stretchers is different from other specified stretchers, and the length of specified ribs is different from other specified ribs and long ribs are connected to long stretchers and short ribs are connected to short stretchers.

According to the present invention, a rib structure for an umbrella is provided which does not give the umbrella unnecessary structural pressure, yet has superior appearance from a fashion standpoint and can contribute to the development of the industry by motivating consumers to buy.

BRIEF DESCRIPTION OF THE DRAWINGS

FIG. 4 is a side view explaining the structure of stretcher 20*d* of umbrella 11 shown in FIG. 3 with the area around the stretcher 20*d* shown in an enlarged manner wherein

FIG. 6 is an enlarged view showing the area around the top notch 33 of the umbrella 31 shown in FIG. 5. This figure explains the structure of the top notch 33 wherein

FIG. 7 is an enlarged view showing the area around the runner 41 of the umbrella 31 shown in FIG. 5. This figure explains the structure of the runner 41 wherein

FIG. 8 shows the side views of the area around the connecting position of the rib and the stretcher of the umbrella 31 shown in FIG. 5. This figure explains the positional relationship of the rib and the stretcher wherein

FIG. 10 shows another example of the runner shown in FIGS. 7A and 7B wherein

FIG. 11 shows another example of the top notch shown in FIGS. 6A and 6B wherein

FIG. 12 shows the fifth example of the top notch wherein

DETAILED DESCRIPTION OF THE PREFERRED EMBODIMENTS

The invention will now be described with respect to the embodiments in detail with reference to drawings. The purpose, action, effects, features, advantages of operation of this invention and other related purposes will become clear by explanation of the preferred embodiment.

The embodiments disclosed as referred to here are just the most preferred ones which were selected and presented out of various possible embodiments to help skilled people with understanding that the technical idea of this invention is not necessarily limited or restricted to these embodiments. Without deviating from the technical idea of this invention, various changes, additions, and alternations as well as other embodiments are possible, and it needs to be clarified that these are also contained within this invention.

It is to be understood that an umbrella of this invention can be either a parasol or an umbrella and that the form and structure of the umbrella proposed in this invention are applicable to stick type umbrellas or folding type umbrellas.

Figure 1:
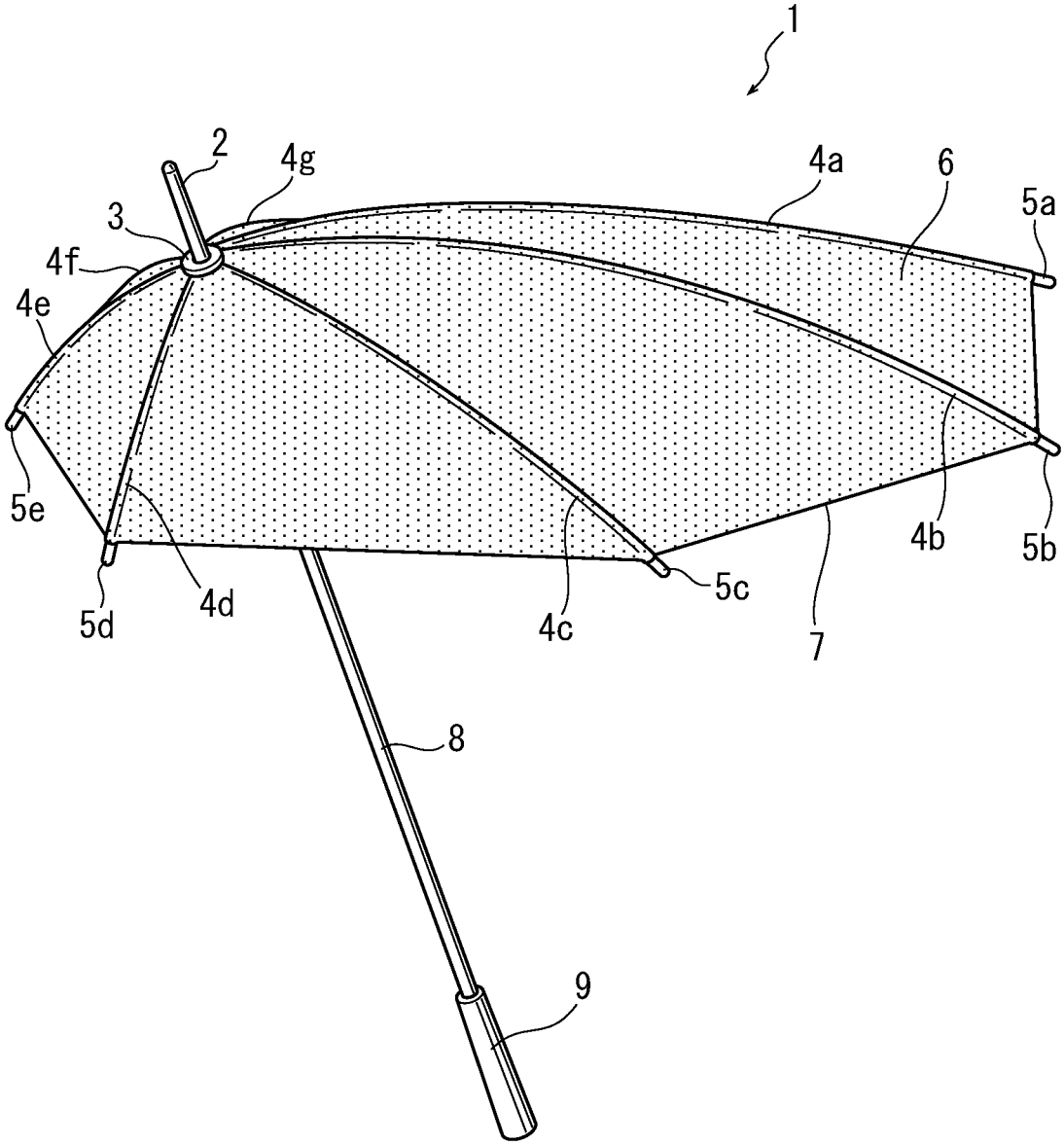
FIG. 1 is a perspective view showing the appearance of the umbrella in one embodiment according to the present invention.

FIG. 1 is a perspective view showing the appearance of the umbrella in one embodiment according to the present invention.

As shown in FIG. 1, umbrella 1 in this embodiment is like traditional umbrellas in that a ferrule 2 is provided at the tip of shaft 8, and a handle 9 is provided in the lower end of the shaft 8.

A top notch 3 is provided under the ferrule 2, and ribs 4*a*, 4*b*, 4*c*, 4*d*, 4*e*, 4*f* and 4*g* are connected to the top notch 3. A runner (not shown), is extrapolated to the shaft 8 and can move along the shaft 8. Each of the stretchers 10*a*,10*b*,10*c*, 10*d*,10*e*,10*f* and 10*g* (shown in FIG. 2)*which* are connected to the runner, support each of the ribs 4*a*,4*b*,4*c*,4*d*,4*e*,4*f* and 4*g*, and the opening and closing of the umbrella 1 is performed by moving the runner along the shaft 8.

Each of tips 5*a*, 5*b*, 5*c*, 5*d*, 5*e*, 5*f* and 5*g* (See FIGS. 1 and 2) is set to each of the ribs 4*a*, 4*b*, 4*c*, 4*d*, 4*e*, 4*f* and 4*g*. The other ends of these ribs are connected to the top notch 3. The tips guide raindrops and prevent the chance of injury from the open tip of each rib.

Each of the tips 5*a*, 5*b*, 5*c*, 5*d*, 5*e*, 5*f* and 5*g*, which is set to each of the ribs 4*a*, 4*b*, 4*c*, 4*d*, 4*e*, 4*f* and 4*g*, is connected with the adjacent tips by a thread 7. By adjusting the length of the thread 7, which connects the adjacent tips, the distance between the adjacent tips can be adjusted and the form of the rib where the tip was set can also be adjusted.

The quality of the material of the thread 7 is not particularly emphasized. As long as it does not separate from the connected tips and as long as a thread 7 has enough intensity and strength to prevent it from snapping, then it is acceptable. For example, it may be a fishing line, nylon yarn, chemical fiber, piano wire, metal thread, other cotton yarn, silk thread and etc.

Also, the thread 7 is not limited to just connecting tips, but may connect the specific position of the rib with a specific position of the adjacent ribs.

Thus, in this embodiment, a variety of forms are defined and can be easily created using each rib by connecting the tips of the ribs with thread.

Also, as shown in FIG. 1, with the umbrella 1, the cloth 6 is stretched on the ribs 4*a*, 4*b*, 4*c*, 4*d*, 4*e*, 4*f* and 4*g*, and provides both rain and sunshine protection. The quality of the material of the cloth 6 may be cotton fabric, vinyl, or paper. Also, materials that have perforations such as lace or net can be used as well (with perforated materials, umbrellas can be used for either sun protection or as a fashion accessory).

The cloth 6 may be pasted on after the form of an umbrella becomes settled with each rib and a thread 7, or conversely, it may settle onto the position of each rib by fixing them to it (they may be tied with a thread or glued with a bonding agent), that is, the umbrella form may be determined by cloth 6. In this case, a thread 7 is not needed. Also, a thread 7 has been tied linearly to the adjacent tips as in FIG. 1. However, if a thread 7 is not used to determine the form, the cloth 6, which connects adjacent tips, may be arranged to bring out the aesthetic qualities of the umbrella by cutting it arbitrarily, for example, into a curve.

Although the top notch 3 can be seen on the cloth 6 in FIG. 1, the top notch 3 may be covered with the cloth 6.

Figure 2:
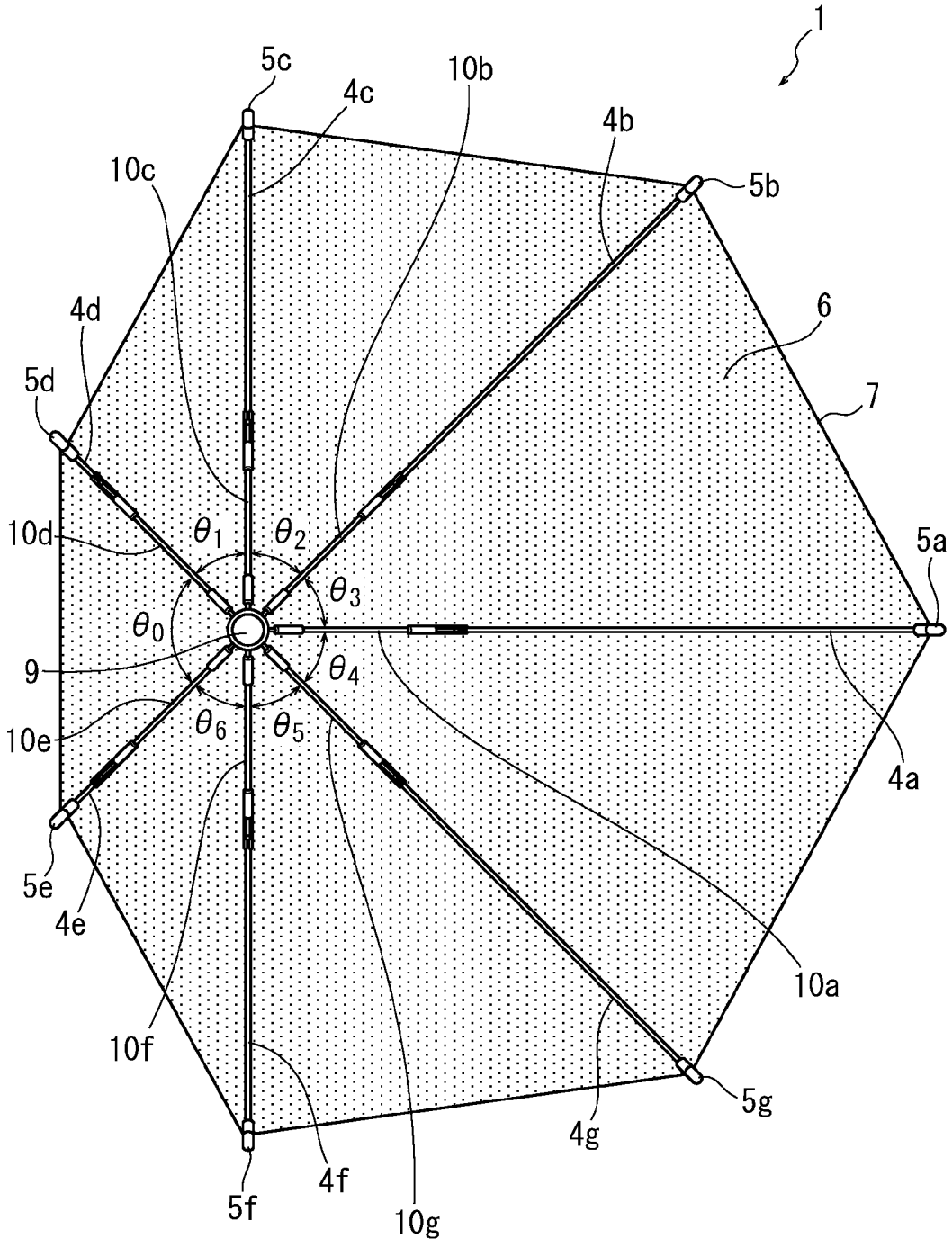
FIG. 2 is a bottom view of the umbrella 1 shown in FIG. 1 seen from the direction of handle 9.

FIG. 2 is a bottom view of the umbrella 1 shown in FIG. 1 seen from the direction of Handle 9.

With the umbrella 1 in this embodiment, ribs 4*a*, 4*b*, 4*c*, 4*d*, 4*e*, 4*f* and 4*g* are set at different angles. That is, in the example of FIG. 2, the angle $\theta_0$ between the rib 4*e* and the rib 4*d*, is different from the angles $\theta_{1\sim6}$ between other specified ribs. This may also work out with an umbrella which has eight ribs with equal angular intervals by removing one rib and one stretcher (by removing a rib and a stretcher between the rib 4*e* and the stretcher 4*d*).

With the umbrella 1 in this embodiment, the angle between the adjacent ribs of the umbrella is made differently with specified ribs. Therefore, it has the effect of producing various forms, such as a seashell, by using ribs of the umbrella and the cloth stretched onto it. Also, by removing some of the ribs from a traditional umbrella structure, the angle between adjacent ribs of the umbrella can be changed and a variety of structures can be realized.

With the umbrella 1 in this embodiment, the length of specified ones of the ribs 4*a*, 4*b*, 4*c*, 4*d*, 4*e*, 4*f* and 4*g* is made different from other specified ribs. In the example of FIG. 2, the rib 4*a* is the longest. Rib 4*b* and rib 4*g* are the same in length and are the next longest after the rib 4*a*. Rib 4*c* and rib 4*f* are the same in length and the next longest after the ribs 4*b* and 4*g*, and rib 4*d* and the rib 4*e* are the same length and also the shortest.

With the umbrella 1 in this embodiment, the length of any specified rib is made differently from other specified ribs. Using this technique with umbrella ribs and the cloth stretched across them, allows one to effectively produce various forms such as a seashell.

In addition, in this embodiment although the umbrella 1 has seven ribs, this invention is not limited to this number of ribs. Nine or eleven ribs are also sufficient, as well as other amounts such as even numbers of ribs.

Next, the second embodiment of this invention will be explained.

Figure 3:
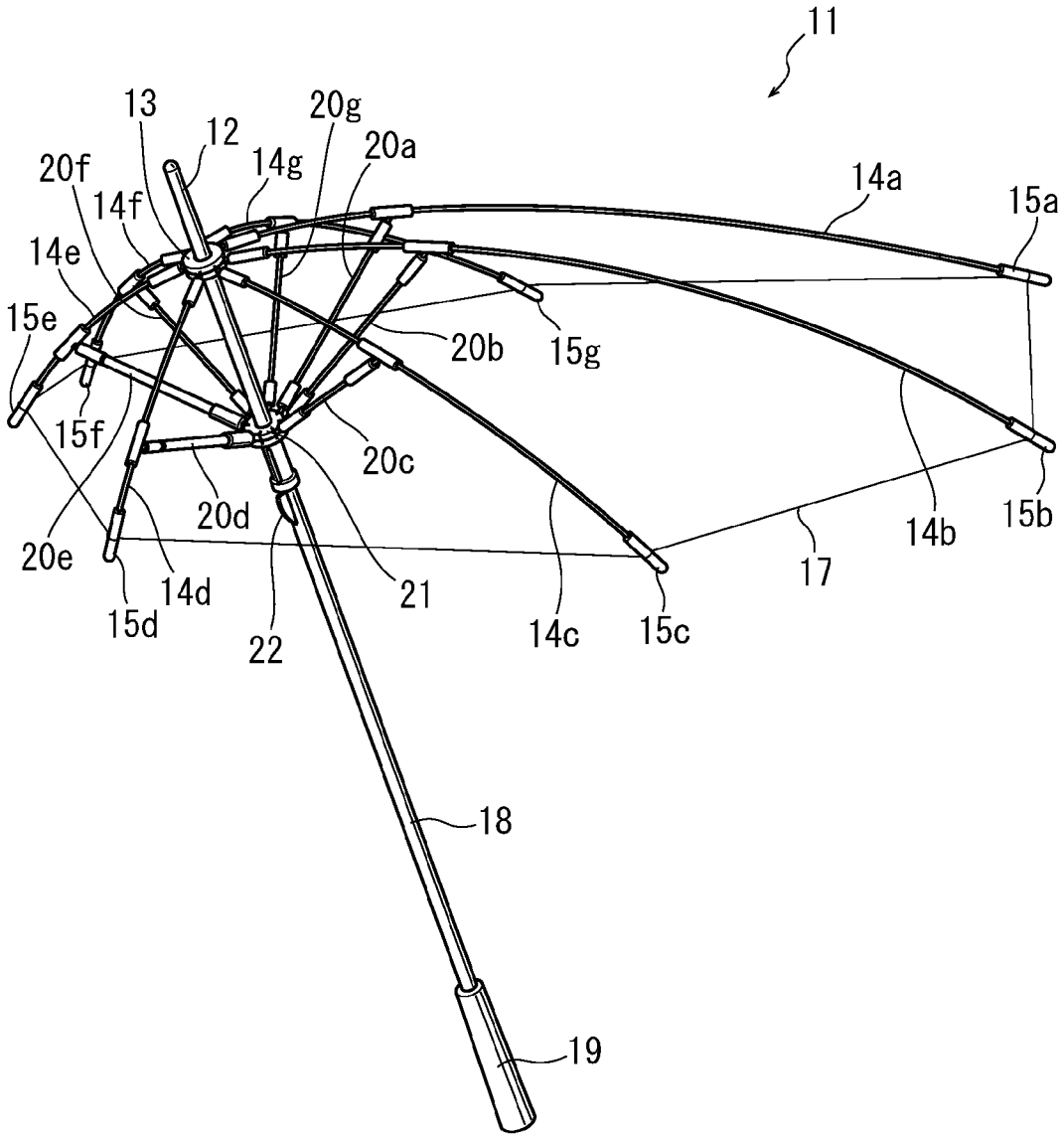
FIG. 3 is a perspective view showing the appearance of the umbrella in a different embodiment from FIG. 1 according to the present invention.

FIG. 3 is a perspective view showing the appearance of the umbrella in the second embodiment according to the invention.

FIG. 3 shows a state in which the cloth for protection from the rain or sun is removed for view-ability of the structure of the umbrella 11, involving this embodiment.

With the umbrella 11 in this embodiment, a ferrule 12 is set at the tip of the shaft 18, and the handle 19 is set at the lower end of the shaft 18.

On the shaft 18, the top notch 13 is set under the ferrule 12, and the ribs 14*a*,14*b*,14*c*,14*d*,14*e*,14*f* and 14*g* are connected to the top notch 13. Also, the runner 21 is extrapolated to shaft 18 and can move along the shaft 18. Each of the stretchers 20*a*, 20*b*, 20*c*, 20*d*, 20*e*, 20*f* and 20*g* which are connected to the runner 21, support each of the ribs 14*a*,14*b*,14*c*,14*d*,14*e*, 14*f* and 14*g*, and the opening and closing of the umbrella 11 is performed by moving the runner 21 along the shaft 18.

In addition, the top spring 22 is set to the shaft 18, preventing the umbrella 11 from closing when the umbrella 11 is in an opened state. This is done by holding the runner 21 which is set on top of the top spring 22. A bottom spring is used to prevent the closed umbrella from opening, however it has been omitted from this embodiment.

Each of the tips 15*a*,15*b*,15*c*,15*d*,15*e*,15*f* and 15*g* is set to each of the ribs 14*a*,14*b*,14*c*,14*d*,14*e*,14*f*, and 14*g*. The other ends of these ribs are connected to the top notch 13. The tips guide the raindrops and prevent the chance of injury from the open tip of each rib.

Each of the tips 15*a*,15*b*,15*c*,15*d*,15*e*,15*f* and 15*g*, which is set to the tip of each of the ribs 14*a*,14*b*,14*c*,14*d*,14*e*,14*f*, and 14*g*, is connected with the adjacent tips by a thread 17. Furthermore, cloth (not shown) is stretched on the ribs 14*a*, 14*b*, 14*c*, 14*d*, 14*e*, 14*f* and 14*g*.

The embodiment shown in FIG. 3 features slightly different stretchers. In the example shown in FIG. 3, stretchers 20*d* and 20*e* have a different structure from other stretchers. This point is explained with reference to FIG. 4.

Figure 4A:
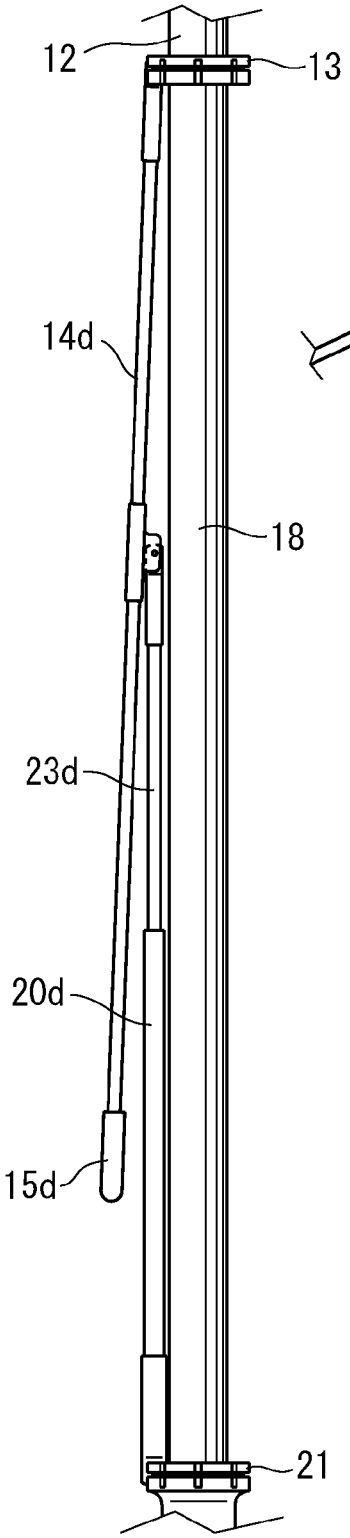
FIG. 4A shows the area around the stretcher 20*d* of the umbrella 11 when closed and FIG. 4B shows the area around the stretcher 20*d* of the umbrella 11 when opened.
Figure 4B:
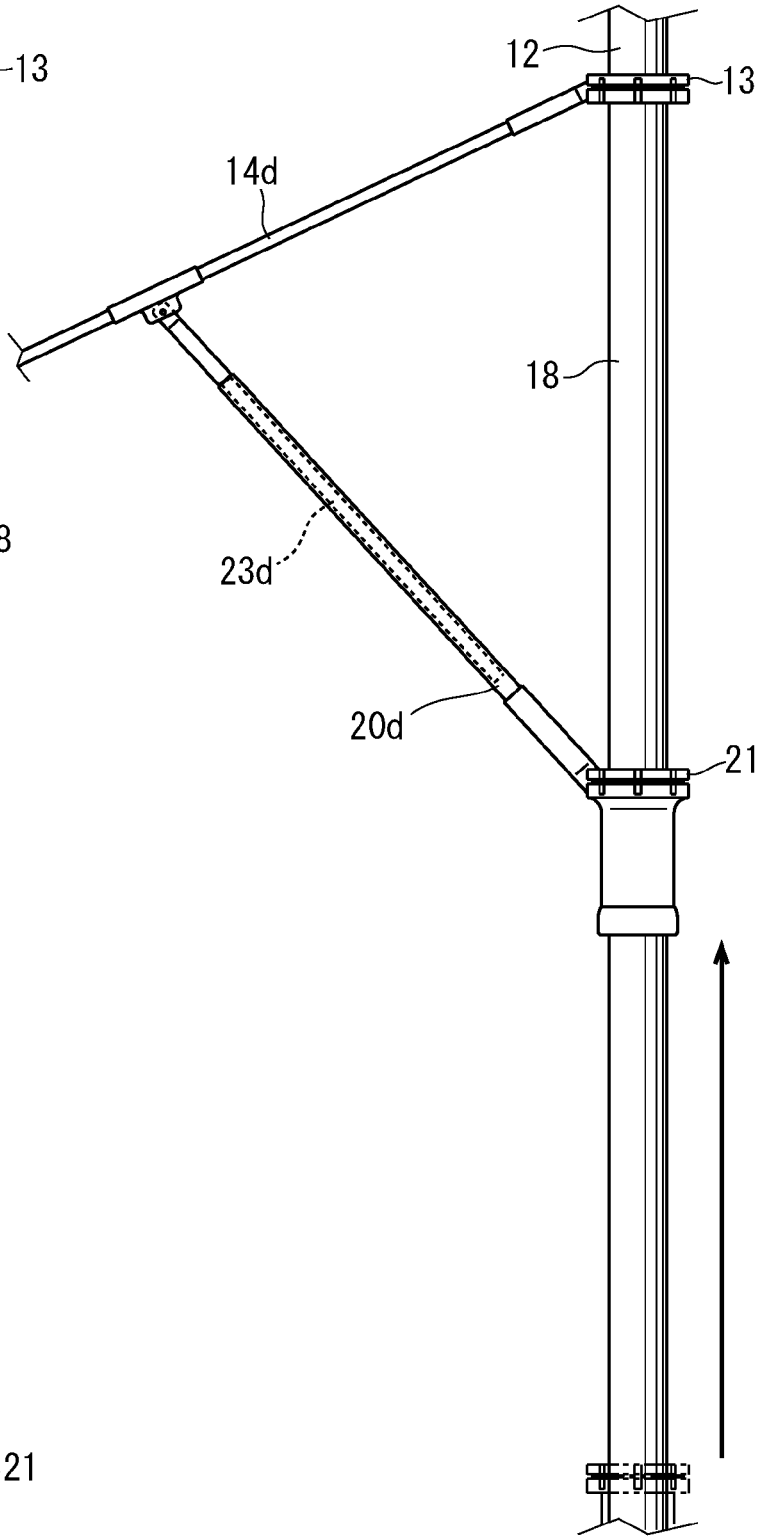

FIG. 4 is enlarged views showing the structure of the stretcher 20*d* of the umbrella 11 shown in FIG. 3 wherein FIG. 4A is a side view showing the area around the stretcher 20*d* of the umbrella 11 when in a closed state and FIG. 4B is a side view showing the area around the stretcher 20*d* of the umbrella 11 when in an open state.

In this embodiment, the stretchers 20*d* and 20*e* have different structures from other stretchers. However, because the stretcher 20*e* has the same structure as the stretcher 20*d*, the stretcher 20*d* is only explained.

As shown in FIGS. 4A and 4B, the stretcher 20*d* is connected with the runner 21 at the lower end, and has the structure of a hollow cylinder where the inner rib 23*d* is inserted at the upper end. Also, the inner rib 23*d* is connected at a specified position on the rib 14*d* (a little closer to the shaft 18 than the center) at the upper end, and the lower end is in a position where it is pushed into the hollow cylinder of the stretcher 20*d*.

As shown in FIG. 4A, in the state where the umbrella 11 is closed, a specified length of the inner rib 23*d* comes out of the stretcher 20*d*. The length of the element which connects the rib 14*d* and the runner 21, that is the stretcher 20*d* and the inner rib 23*d*, extend. The stretcher 20*d* and the inner rib 23*d* work together and become a stretcher. On the other hand, as shown in FIG. 4B, where the umbrella is in an open state, the inner rib 23*d* is slid and pushed all the way into the stretcher 20*d*. The length of the element which connects the rib 14*d* and the runner 21, that is the stretcher 20*d* and the inner rib 23*d*, shorten. The stretcher 20*d* and the inner rib 23*d* function as a stretcher.

Furthermore, in this embodiment, although the stretchers 20*d* and 20*e* have an inner rib functional structure (telescopic structure) that is different from other stretchers, this invention is not limited to this, and a specified numbers of stretchers among multiple stretchers may have inner rib functional structures.

Thus, according to this embodiment, since the length of the specified stretcher among stretchers which are connected with the ribs is able to change, the umbrella does not receive unnecessary force and is protected from breakage.

In addition, the length of the stretcher, which is connected with the rib, can change according to the length of the rib. In this case, the umbrella does not receive unnecessary force thus protecting the umbrella from breakage.

Also, according to this embodiment, since the specified stretcher is made to have an inner rib function with sliding ability, the length of the stretcher changes according to the operation of opening and closing the umbrella. Therefore, the umbrella does not receive unnecessary force, thus protecting it from breakage.

Next, the third embodiment of this invention will be explained

Figure 5:
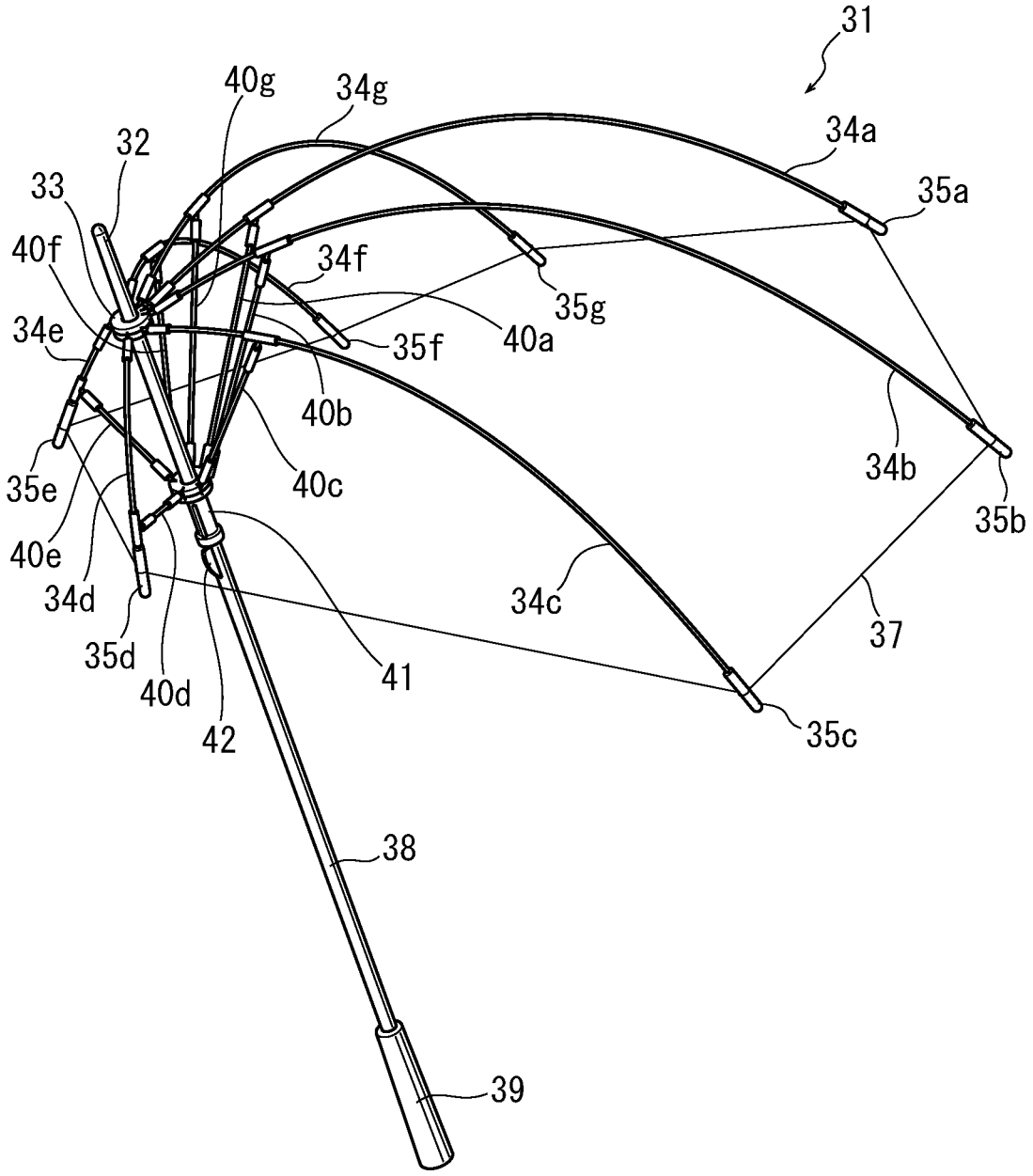
FIG. 5 is a perspective view showing the appearance of the umbrella in a further different embodiment from FIGS. 1 and 3 according to the present invention.

FIG. 5 is a perspective view showing the appearance of the umbrella in the third embodiment according to the present invention.

FIG. 5 shows the state where the cloth for protection from the rain or sun is removed for viewability of the structure of the umbrella 31 according to this embodiment.

With the umbrella 31 in this embodiment, the ferrule 32 is provided at the tip of the shaft 38, and the handle 39 is provided at the lower end of the shaft 38.

The top notch 33 is provided under the ferrule 32 and ribs 34*a*, 34*b*, 34*c*, 34*d*, 34*e*, 34*f* and 34*g* are connected with the top notch 33. Also, the runner 41 is extrapolated to the shaft 38 and can move along the shaft 38. Each stretcher is connected to the runner 41. Stretchers 40*a*,40*b*,40*c*,40*d*,40*e*,40*f* and 40*g* support each of the ribs 34*a*,34*b*,34*c*,34*d*,34*e*,34*f* and 34*g*, and the opening and closing of the umbrella 11 are performed by moving the runner 41 along the shaft 38.

In addition, the top spring 42 is provided on the shaft 38, preventing the umbrella 31 from closing by setting the runner 41 on the top spring 42 when the umbrella 31 is in an open state.

Tips 35*a*, 35*b*, 35*c*, 35*d*, 35*e*, 35*f* and 35*g* are provided to one tips of the rib 34*a*, 34*b*, 34*c*, 34*d*, 34*e*, 34*f* and 34*g*, respectively. The other tips of these ribs are connected to the top notch 33. These tips function to guide raindrops and prevent the chance of injury from the open tip of each rib.

Each of the tips 35*a*, 35*b*, 35*c*, 35*d*, 35*e*, 35*f* and 35*g* provided on each of the rib 34*a*, 34*b*, 34*c*, 34*d*, 34*e*, 34*f* and 34*g*, is connected with the adjacent tips by a thread 37. Furthermore, cloth (not shown) is stretched onto the ribs 34*a*, 34*b*, 34*c*, 34*d*, 34*e*, 34*f* and 34*g*.

The embodiment shown in FIG. 5 features the top notch and the runner as will be explained with reference to FIGS. 6 and 7.

Figure 6A:
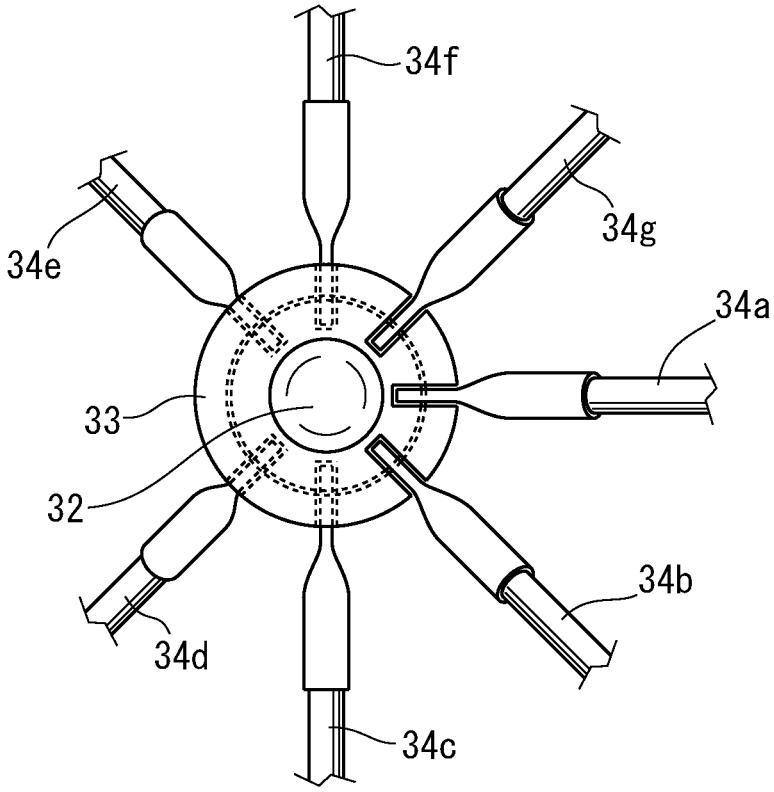
FIG. 6A is a plan view showing the area around the top notch seen from the direction of ferrule 32 and FIG. 6B is a side view showing the area around the top notch 33 in which the umbrella 31 is in an open state.
Figure 6B:
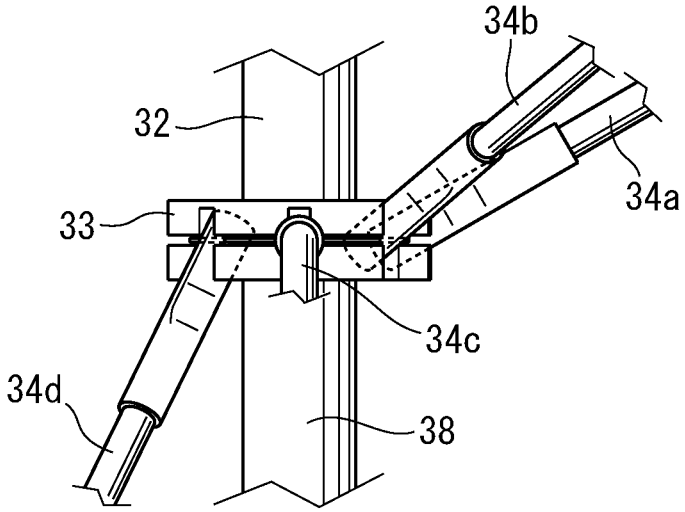

FIG. 6 is an enlarged view showing the area around the top notch 33 of the umbrella 31 shown in FIG. 5 for explaining the structure of the top notch 33, wherein FIG. 6A is a plan view of the area around the top notch 33 from the direction of the ferrule 32, and FIG. 6B is a side view showing the area around the top notch 33 where the umbrella 31 is in an open state.

As shown in FIG. 6A, the upper part of the top notch 33 in this embodiment is cut at the connecting point with the ribs 34*a*, 34*b* and 34*g* so that vertical movement of these ribs can be extended. With such a structure as in the top notch 33, as shown in FIG. 6B, the ribs 34*a*, 34*b* and 34*g* can vertically move upward beyond the upper plane of the top notch 33 perpendicular to the direction of the axis of the shaft 38.

According to this embodiment, since the vertical operational range of the specified rib at the point where the rib is connected with the top notch, is extended, the umbrella doesn't receive unnecessary force and is protected from breakage. Furthermore, this enables the umbrella to be opened and closed smoothly and to create and desired forms can be created by this use of the ribs.

Figure 7A:
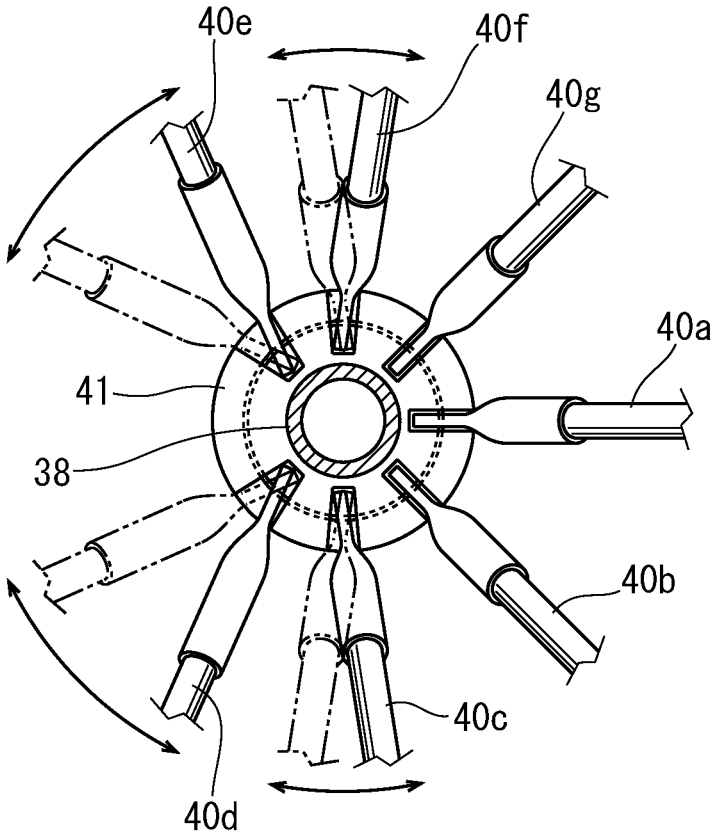
FIG. 7A is a plan view showing the area around the runner 41 seen from the direction of ferrule 32 with the shaft 38 cut and FIG. 7B is a side view showing the area around the runner 41 in which the umbrella 31 is in an open state.
Figure 7B:
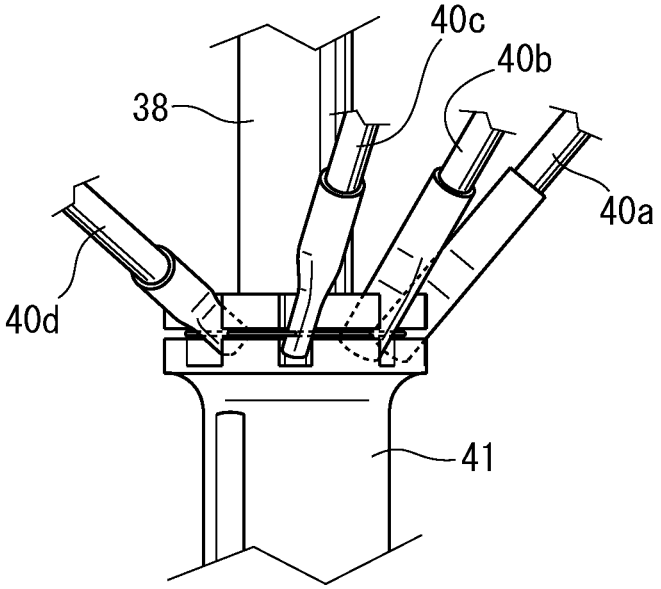

FIG. 7 shows enlarged views of the area around the runner 41 of the umbrella 31 shown in Fig. They explain the structure of the runner 41 wherein FIG. 7A is a plan view showing the area around the runner 41 seen from the direction of the ferrule 32 with the shaft 38 cut and FIG. 7B is a side view showing the area around the runner 41 of the umbrella 31 when the umbrella 31 is in an open state.

As shown in FIG. 7A, the runner 41 is cut at the point where the stretchers 40*c*, 40*d*, 40*e* and 40*f* are connected so that those stretchers can move in a broader angle rightwards and leftwards in a horizontal plane. This enables stretchers 40*c*, 40*d*, 40*e* and 40*f* to move angularly in a horizontal plane with respect to the shaft 38.

According to this embodiment, horizontal operational range of the specified stretchers at the point where those stretchers are connected with the runner, is horizontally broadened, so that the umbrella is not subject to unnecessary force and is protected from breakage. Furthermore, this enables the umbrella to be opened and closed smoothly and to create desired forms in cooperation with the ribs.

Also, by cutting specified parts of the top notch and runner from an ordinary umbrella, a structure like this can easily expand the horizontal operational range of the ribs.

Also, in the examples shown in FIGS. 6A and 6B, the operational range in the horizontal direction of the top notch 33 is not expanded, however, the operational range in the horizontal direction of Top notch 33 may be expanded such as with the runner 41.

The embodiment shown in FIG. 5 is characterized by the positional relationship of the ribs and the stretchers. This point will be explained with reference to FIG. 8.

Figure 8A:
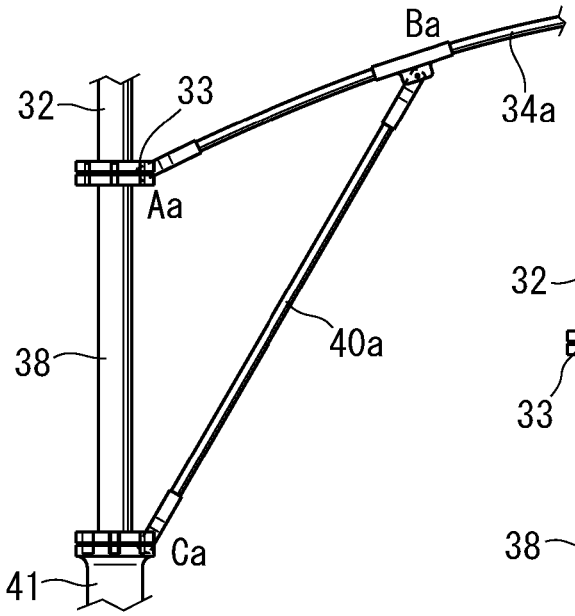
FIG. 8A shows the relation of the rib 34*a* and stretcher 40*a*.
Figure 8B:
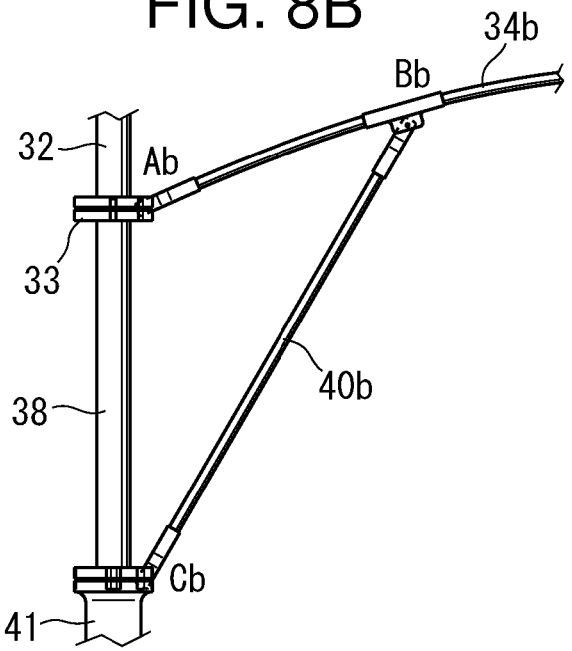
FIG. 8B shows the relation of the rib 34*b* and stretcher 40*b*.
Figure 8C:
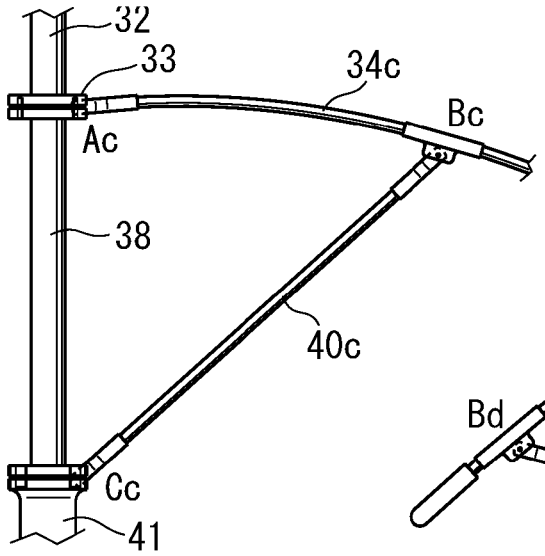
FIG. 8C shows the relation of the rib 34*c* and stretcher 40*c*.
Figure 8D:
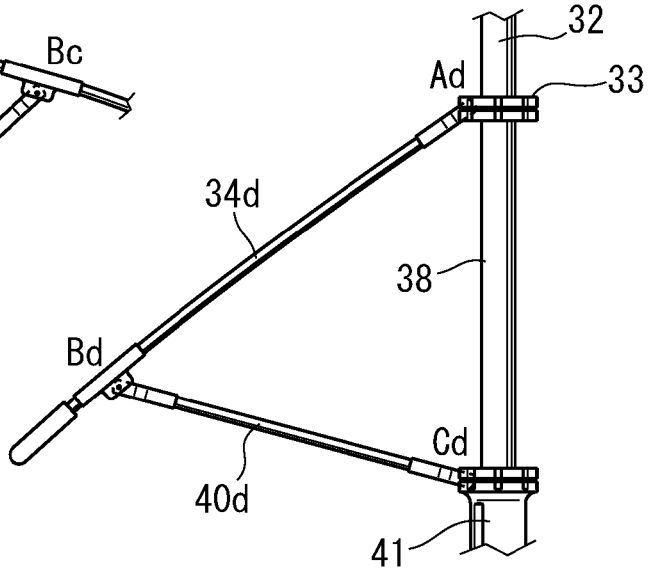
FIG. 8D shows the relation of the rib 34*d* and stretcher 40*d;*

FIG. 8 shows side views of the area around the connecting position of the rib and the stretcher of the umbrella 31 shown in FIG. 5 to explain the positional relationship of the rib and the stretcher wherein FIG. 8A shows the relation of the rib 34*a* and stretcher 40*a*, FIG. 8B shows the relation of the rib 34 *b* and stretcher 40 *b*, FIG. 8C shows the relation of the rib 34 *c* and stretcher 40*c* and FIG. 8D shows the relation of the rib 34 *d* and stretcher 40 *d*.

In the embodiment shown in FIG. 5, the positional relationship of the rib 34*g* and the stretcher 40*g* is the same as the positional relationship of the rib 34*b* and the stretcher 40*b*. The positional relationship of the rib 34*f* and the stretcher 40*f* is the same as the positional relationship of the rib 34*c* and the stretcher 40*c*. The positional relationship of the rib 34*e* and the stretcher 40*e* is the same as the positional relationship of the rib 34*d* and the stretcher 40*d*. Therefore, the positional relationship of the rib 34*g* and the stretcher 40*g*, the positional relationship of the rib 34*f* and the stretcher 40*f* and the positional relationship of the rib 34*e* and the stretcher 40*e* are shown in FIG. 5.

The embodiment shown in FIG. 5 shows the difference of the length of specified ribs from other specified ribs among the multiple ribs of the umbrella 31. As shown in FIGS. 8A~8D, the stretcher 40*a* is the longest. The stretcher 40*b* and the stretcher 40*g* are of the same length and are the second longest. The stretcher 40*c* and the stretcher 40*f* are the same length and are the third longest. And the stretcher 40*d* and the stretcher 40*e* are of the same length and are the shortest.

In this embodiment, the positional relationship of the ribs and stretchers are set at different positions according to the length of the stretchers.

As shown in FIG. 8A, with respect to the longest stretcher 40*a*, the position where the stretcher 40*a* is connected to the rib 34*a* is closest to the top notch 33. That is, on the rib 34*a*, the length from the position "Aa" where the rib 34*a* is connected to the top notch 33 to the position "Ba" where the stretcher 40*a* is connected to the rib 34*a*, is shorter than the others.

As shown in FIG. 8B, with respect to the second longest stretcher 40*b*, the position "Bb" where the stretcher 40*b* is connected to the rib 34*b* is the second closest to the top notch 33. That is, on the rib 34*b*, the length from the position "Ab"

where the rib 34*b* is connected to the top notch 33 to the position "Bb" where the stretcher 40*b* is connected to the rib 34*b*, is the second shortest.

As shown in FIG. 8C, with respect to the third shortest stretcher 40*c*, the position "Bc" where the stretcher 40*c* is connected to the rib 34*c* is the third closest to the top notch 33. That is, on the rib 34*c*, the length from the position "Ac" where the rib 34*c* is connected to the top notch 33 to the position "Bc" where the stretcher 40*c* is connected to the rib 34*c*, is the third shortest.

As shown in FIG. 8D, with the shortest stretcher 40*d*, the position where the stretcher 40*d* is connected with the rib 34*d* is the farthest from the top notch 33. That is to say, the length from the position "Ad" where the rib 34*d* is connected with the top notch 33 to the position "Bd" where the stretcher 40*d* is connected with the rib 34*d* is the longer than any other length.

That is, in order to open and close an umbrella smoothly, assuming the distance from the position "Aa" to the position "Ba" being represented as Aa~Ba, it is desired to provide the following relation; (Aa~Ba+Ba~Ca)=(Ab~Bb+Bb~Cb)=(Ac~Bc+Bc~Cc)=(Ad~Bd+Bd~Cd).

According to this embodiment, as lengths of the stretchers connected with the ribs are made different and the connecting positions of the ribs and the stretchers are adjusted accordingly, the umbrella will be subject to no unnecessary pressure and be protected from breakage. It becomes possible to produce desired forms of an umbrella with the ribs as well.

According to this embodiment, as lengths of the stretchers connected with the ribs are made different according to the length of the rib and the connecting positions of the ribs and the stretchers are adjusted accordingly, the umbrella will be subject to no unnecessary pressure and be protected from breakage. It becomes possible to form desired forms of an umbrella with the ribs as well.

Incidentally, although the handle 9 of the umbrella 1 shown in FIG. 1, the handle 19 of the umbrella 11 shown in FIG. 3 and the handle 39 of the umbrella 31 shown in FIG. 5 are of a straight stick form, this invention is not limited to the form and therefore the form of handles may be different. One example of the handles is shown in FIG. 9.

Figure 9:
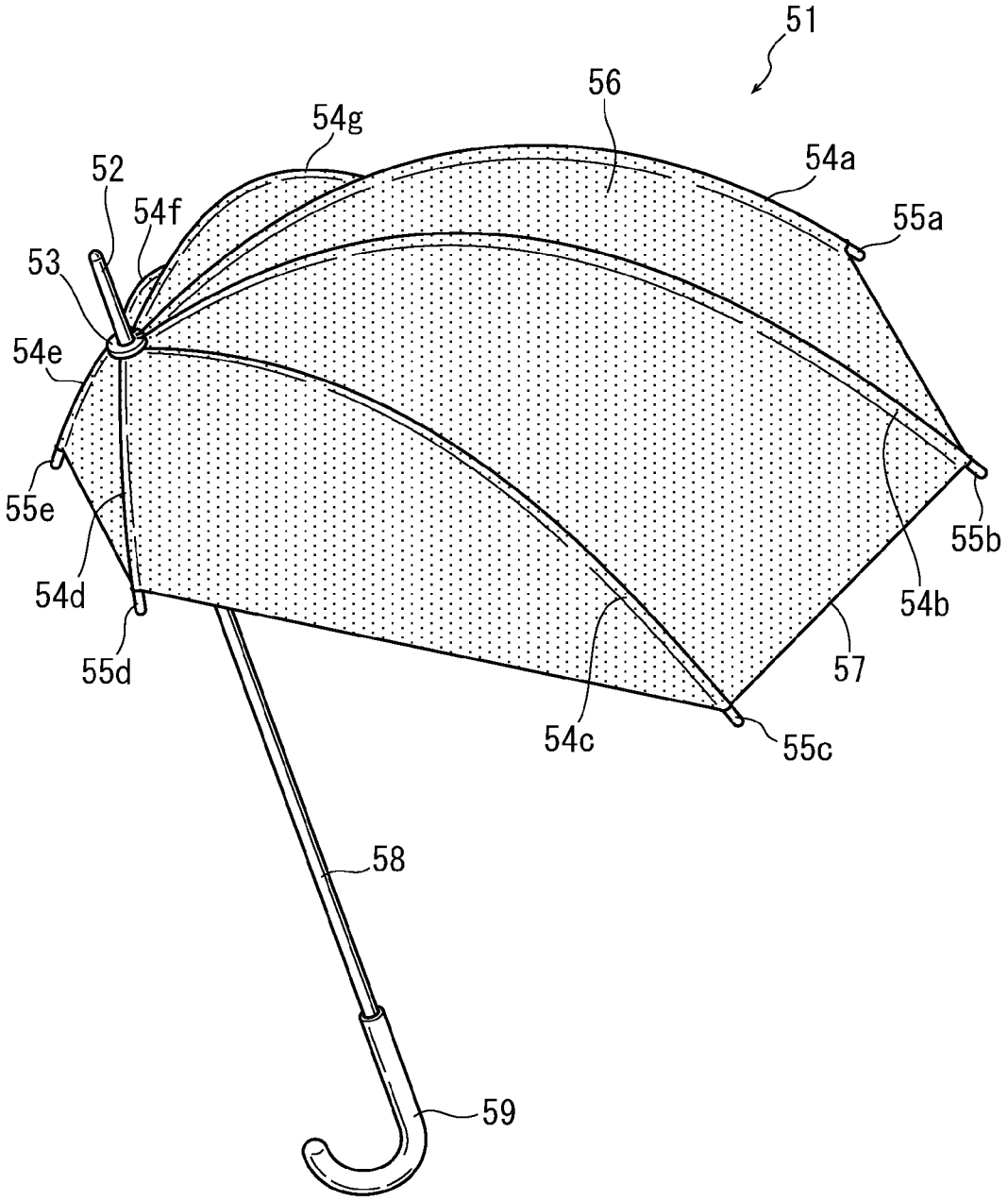
FIG. 9 is a perspective view showing the appearance of the umbrella in the fourth embodiment according to the present invention.

FIG. 9 is a perspective view showing the appearance of the umbrella in the fourth embodiment according to the present invention.

As shown in FIG. 9, with the umbrella 51 in this embodiment, a ferrule 52 is provided at the tip of the shaft 58, and a handle 59 is provided at the lower end of the shaft 58.

The handle 59 curves at the tip and such a form of handle is effective in preventing the umbrella 51 from spinning on the center of the shaft 58. It is also effective in making the opening and closing smoother by grasping the portion of the handle which is not parallel to the shaft 58.

Furthermore, it is preferable from a standpoint of fashion that is aesthetic visual appeal to design the tip of the handle 59 to curve away in an axially symmetric direction with respect to the longest rib of a plurality of ribs of the umbrella (rib 54*a* shown in FIG. 9).

Figure 10A:
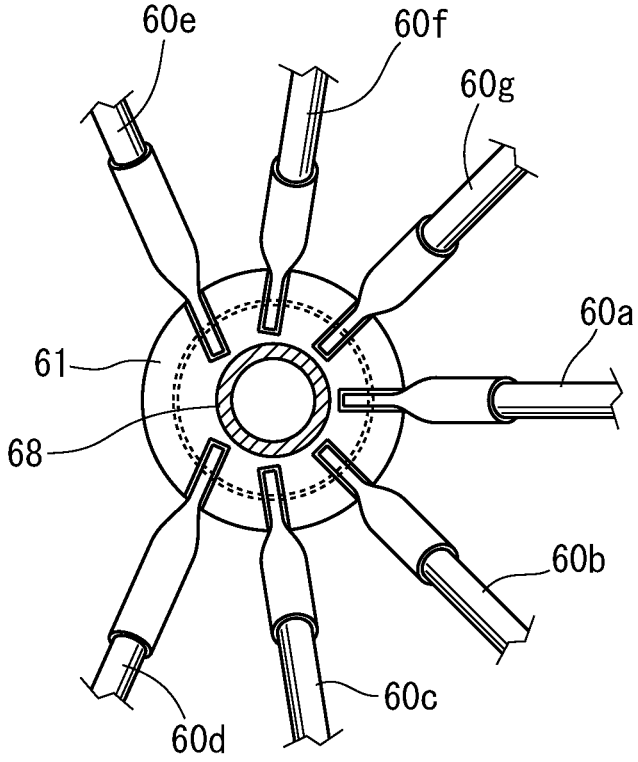
FIG. 10A is a plan view showing the area around the runner 41 seen from the direction of ferrule 32 with the shaft 38 cut and FIG. 10B is a side view showing the area around the runner 41 in which the umbrella 31 is in an open state.

FIG. 10 shows another example of the runner shown in FIGS. 7A and 7B wherein FIG. 10A is a plan view showing the area around the runner 41 seen from the direction of ferrule 32 with the shaft 38 cut and FIG. 7B is a side view showing the area around the runner 41 of the umbrella 31 when opened.

In the example shown in FIGS. 7A and 7B, the runner 41 is cut on its circumference at the point where the stretchers 40*c*, 40*d*, 40*e* and 40*f* are connected with the runner 41 to broaden the movable range of the ribs in rightward and leftward directions or in a horizontal direction. However, in the example shown in FIGS. 10A and 10B, the stretchers 60*a*~60*g* are directed in a horizontal plane differently from the conventional ones at the connecting point with the runner 61.

In a traditional umbrella, stretchers are directed radially from the center of the runner at the position connecting with the runner as seen horizontally. However, in the example shown in FIGS. 10A and 10B, the stretchers 60*a*~60*g* are connected with the runner 61 in the same directions as the stretches 40*a*~40*g* shown in solid lines in FIGS. 7A and 7B but without movable ranges as shown in FIG. 7A. In other words, in the example shown in FIGS. 10A and 10B, the specified stretchers 60*c*, 60*d*, 60*e* and 60*f* of the multiple stretchers 60*a*~60*g* are connected to the runner 61 in the directions directed out of the center of the runner 61.

Figure 10B:
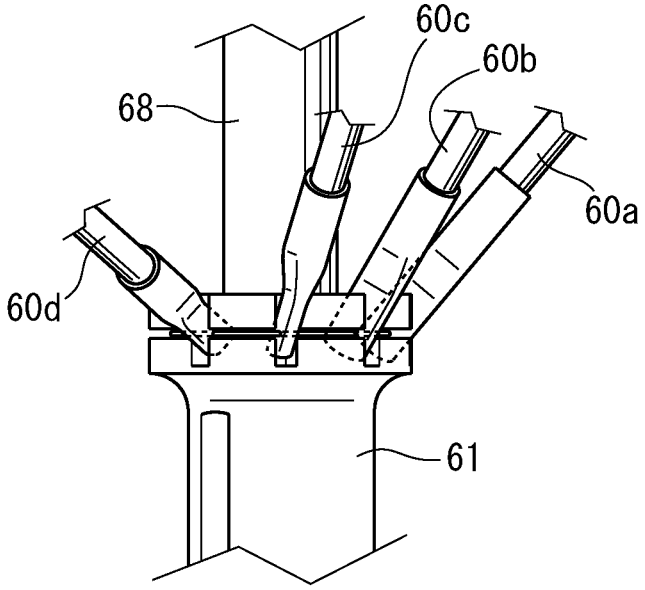

With the examples shown in FIGS. 10A and 10B as well, desired forms of umbrellas can be created with these ribs.

While explanation has been given on the horizontal directions of the stretches with reference to the example shown in FIGS. 10A and 10B, it may also apply to the direction of the ribs connected with the top notch. That is, it is possible to create desired forms of the umbrella by changing the direction of the ribs at the connecting position with the top notch differently from the traditional one.

Figure 11A:
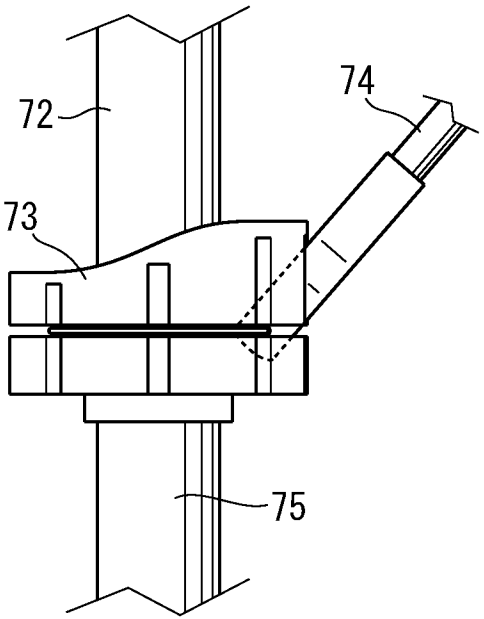
FIG. 11A is a side view showing the second example of the top notch.
Figure 11B:
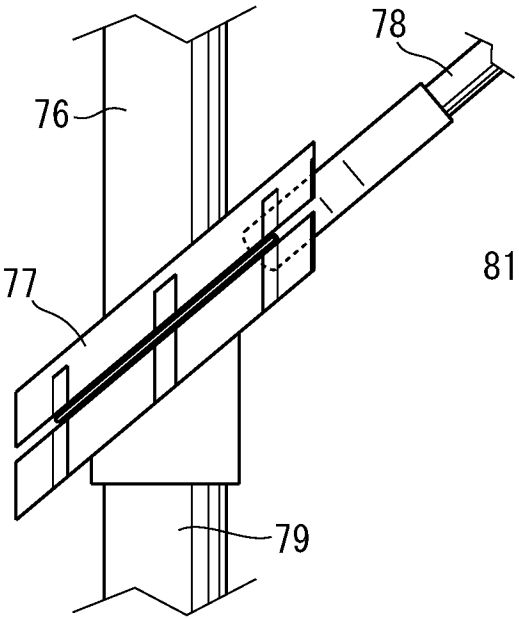
FIG. 11B is a side view showing the third example of the top notch and FIG. 11C is a side view showing the fourth example of the top notch.
Figure 11C:
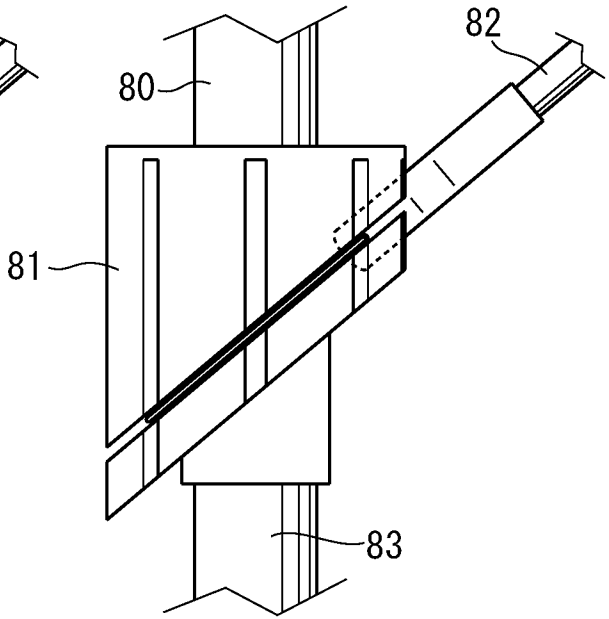

FIG. 11 shows another example of the top notch shown in FIGS. 6A and 6B wherein FIG. 11A is a side view showing the second example of the top notch, FIG. 11B is a side view showing the third example of the top notch and FIG. 11C is a side view showing the fourth example of the top notch.

While in the example shown in FIGS. 6A and 6B, the upper portion of the top notch 33 is completely cut at the portion where the ribs 34*a*, 34*b* and 34*g* are connected with the top notch 33 so that the movable range of the ribs 34*a*, 34*b* and 34*g* can be broadened, this invention is not limited to this example, but a variety of desired forms of umbrellas can be created by providing various modifications of the connections of the ribs with the runner.

For instance, in the example shown in FIG. 11A, unlike the top notch 33 shown in FIG. 6, a top notch 73 provided between a shaft 75 and a ferrule 72 is not cut in its upper portion completely, but is provided with a long slot so that the vertical operational range of the rib 74 as an example can be broadened more than traditional ones. Also in this case it will be able to create desired forms of the umbrella by the ribs.

In the example shown in FIG. 11B, specified ribs of the multiple ribs are connected in different vertical positions from other specified ribs with the top notch 77 provided between the shaft 79 and the ferrule 76 instead of different length of slots provided in the top notch 77 as shown in FIG. 11A. In this case also by using this top notch, desired forms can be created.

In the example shown in FIG. 11C, the top notch 81 provided between the shaft 83 and the ferrule 80, is made by lengthening the slot, similar to the top notch 73 shown in FIG. 11A. At the same time this allows the connecting position of the ribs with the top notch to be different like the other example shown in FIG. 11B. In this case by also using this top notch, desired forms of the umbrella can be created.

Although FIGS. 11A, 11B and 11C show the examples of different forms of the top notches, this invention is not limited to those top notches, and the runners may also be formed in the same shapes as the top notches shown in FIGS. 11A, 11B and 11C.

Figure 12A:
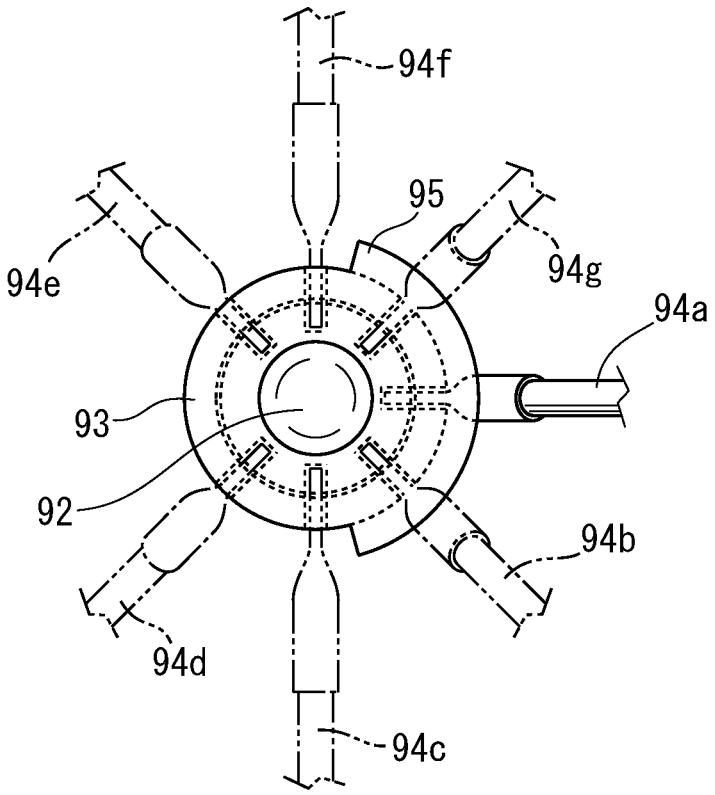
FIG. 12A is a plan view showing the area around the top notch 93 seen from the direction of ferrule 92 and FIG. 12B is a side view showing the area around the top notch 93 in which the umbrella is in an open state.
Figure 12B:
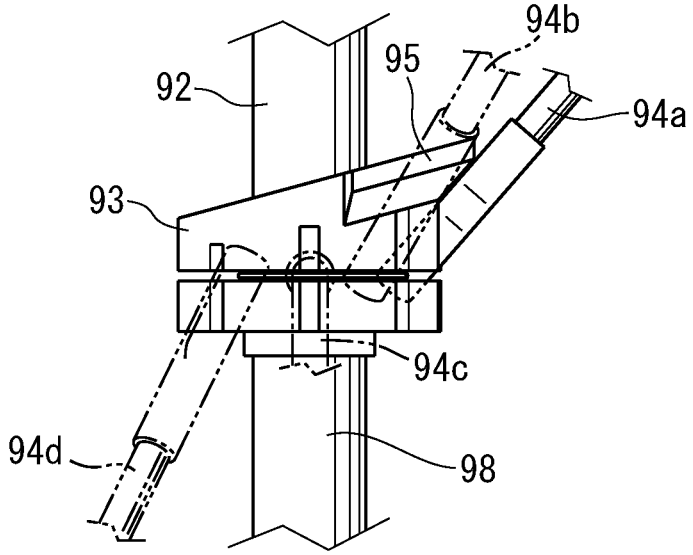

FIG. 12 shows the fifth example of the top notch wherein FIG. 12A is a plan view showing the area around the top notch 93 seen from the direction of ferrule 92 and FIG. 12B is a side view showing the area around the top notch 93 of the umbrella when opened.

In the fifth example, the top notch 93 has a protruding rim 95 which is positioned above the slot at which ribs 94*a*, 94*b* and 94*g* are connected with the top notch 93.

The protruding rim 95 serves to support the ribs 94*a*, 94*b* and 94*g* and reinforce the umbrella when each of the ribs 94*a*, 94*b* and 94*g* move vertically when opening the umbrella. The protruding rim 95 is in a form which can support the ribs 94*a*, 94*b* and 94*g* with the surface at the position where the ribs 94*a*, 94*b* and 94*g* are fixed when the umbrella is opened. It has the effect of reinforcing the umbrella when it is opened and can be used to stabilize the ribs.

Next, a further embodiment of this invention will now be explained.

Figure 13:
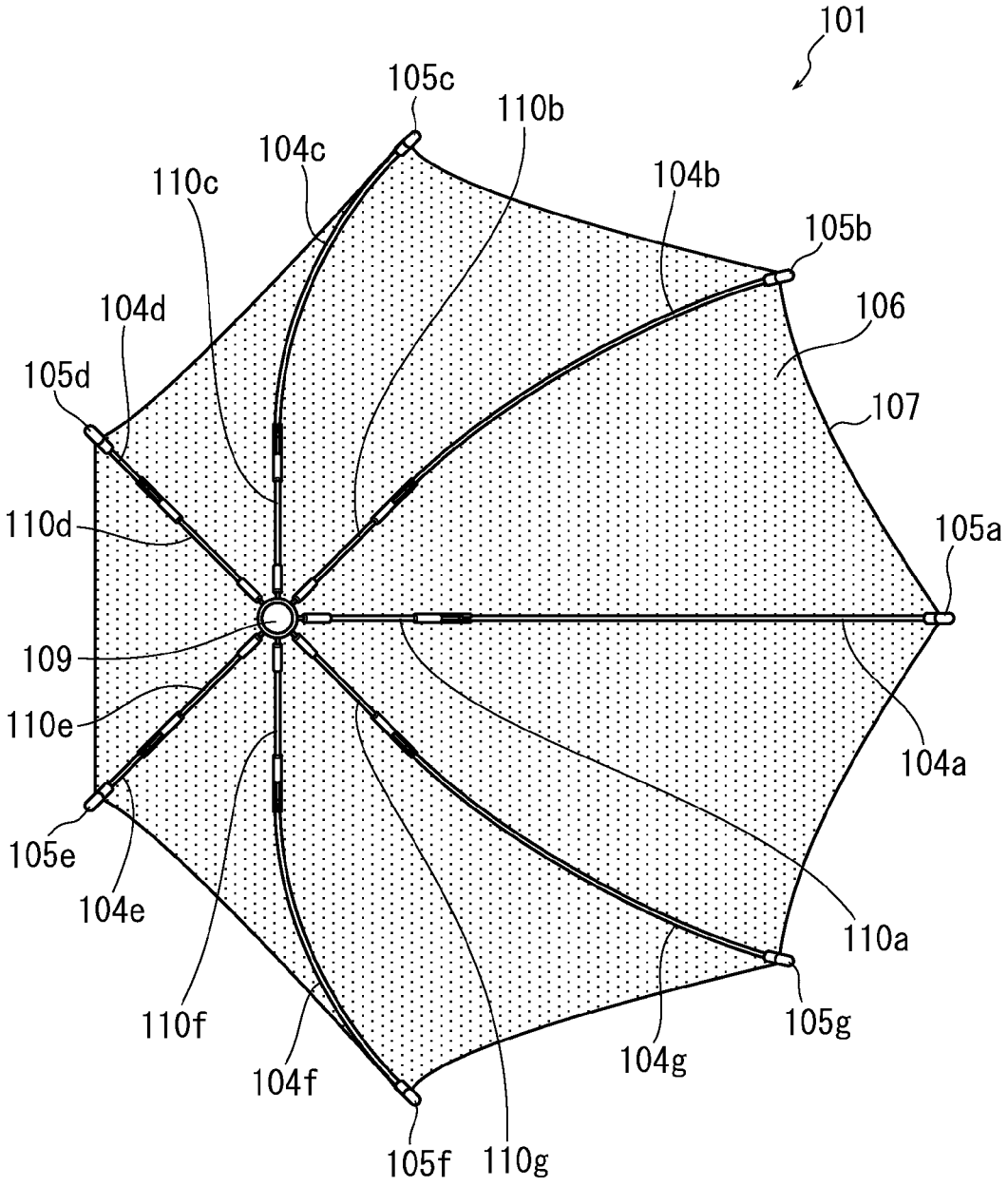
FIG. 13 is a bottom view showing the fifth embodiment of the umbrella according to the present invention seen from the direction of the handle.

FIG. 13 is a bottom view showing the fifth embodiment of the umbrella according to the present invention seen from the direction of a handle 109.

With an umbrella 101 in this embodiment, a ferrule is provided at the tip of the shaft and the handle 109 is provided on the lower end of the shaft. In FIG. 13, the ferrule and the shaft are behind the handle 109 and not shown.

A top notch (not shown) is positioned just under the ferrule, and ribs 104*a*,104*b*,104*c*,104*d*,104*e*,104*f* and 104*g* are connected to this top notch. A runner (not shown) is extrapolated to the shaft and can move along the shaft. Stretchers 110*a*, 110*b*,110*c*,110*d*,110*e*,110*f* and 110*g* are connected to the runner and support ribs 104*a*,104*b*,104*c*,104*d*,104*e*,104*f* and 104*g*, respectively. The opening and closing of the umbrella 101 is performed by moving the runner along the shaft.

Tips 105*a*,105*b*,105*c*,105*d*,105*e*,105*f* and 105*g* are attached to the ribs 104*a*,104*b*,104*c*,104*d*,104*e*,104*f* and 104*g*, respectively. The other ends of these ribs are connected to the top notch. These tips serve to guide the raindrops and prevent possible injury caused by the open tip of each rib.

The adjacent tips 105*a*, 105*b*, 105*c*, 105*d*, 105*e*, 105*f* and 105*g* are all connected with each other by a thread 107. Furthermore, cloth (not shown) is stretched on the ribs 104*a*, 104*b*, 104*c*, 104*d*, 104*e*, 104*f* and 104*g* of the umbrella 101.

The umbrella 101 in this embodiment features that specified ribs among the ribs 104*a*, 104*b*, 104*c*, 104*d*, 104*e*, 104*f* and 104*g* are curved in the direction of the surface perpendicular to the axial direction of the shaft. That is, when the umbrella is in an open state, the ribs are curved in different directions so that each rib moves when opening and closing the umbrella.

In the example shown in FIG. 13, the rib 104*c* is curved so that the tip 105*c* attached to the tip of the rib 104*c* faces the direction of the tip 105*b*. Also the rib 104*f* is curved so that the tip 105*f* attached to the tip of the rib 104*f* faces the direction of the tip 105*g*. Also, the rib 104*b* is curved so that the tip 105*b* attached to the tip of the rib 104*b* faces the direction of the tip 105*a*. Also the rib 104*g* is curved so that the tip 105*g* attached to the tip of the rib 104*g* faces to the direction of the tip 105*a*. It is preferable that each rib returns to their straight position when the umbrella 101 is closed.

The curve of these ribs may be formed with the tension of the thread 107 which connects the tips. Also, ribs may be curved by the tension of a cloth 106 by fixing each rib to the cloth 106 at specified positions. In order to fix the specified position of each rib and the specified position of the cloth 106, they may be bound with thread or glue which has the required strength.

The material of the ribs may be plastic, metal, carbon fiber, glass fiber and anything with ability to curve. It is preferable to use carbon fiber or glass fiber for lighter weight. Also, by choosing the level of flexibility of the ribs, (that is how easy they bend or curve) as needed, arbitrary forms of an umbrella can be created. The level of flexibility of the ribs may be chosen by changing the quality of material, or the thickness of the ribs themselves. Also, different forms of umbrellas may preferably be created by using multiple ribs, which have different levels of flexibility for one umbrella. Also, you may set a level of higher flexibility for short ribs, as well as long ribs, set a level of lower flexibility for short ribs as well as for long ribs, or set multiple levels of flexibility for any specified ribs.

The material of the cloth 106 may be cotton, linen, silk and any other known natural or chemical fibers. It is advisable to have a UV coating (Ultraviolet blocking process) when used for parasols. Also, for the cloth 106, elastic material may be used. It is preferable to use cloth which can express the beauty of the form when the umbrella is in an open state, even though the level of elasticity of the cloth may be relatively lower.

The cloth 106 may be one piece of cloth which can cover the entire umbrella from one tip to another or multiple pieces of cloth sewn together covering specified ribs and adjacent ribs. For example, number of pieces of cloth sewn together may be adjusted to provide covering between the ribs 104*c* and 104*a* with one piece of cloth.

With the umbrella 101 in this embodiment, the specified ribs curve in the direction of the surface perpendicular to the axial direction of the shaft. Therefore, a more beautiful form of the umbrella can be produced by the ribs of the umbrella and cloth stretched on it.

Further embodiment of this invention will be explained.

Figure 14:
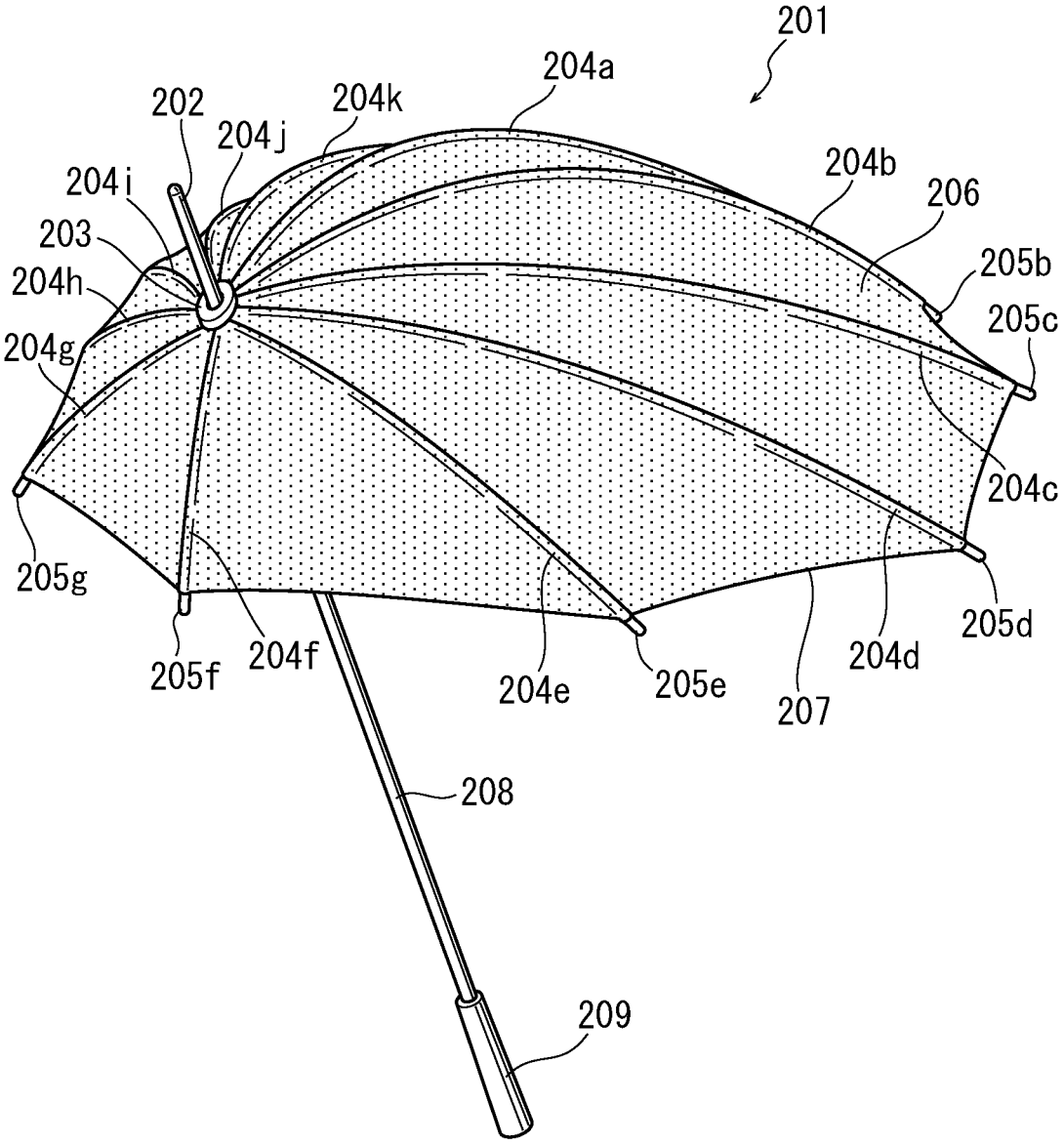
FIG. 14 is a perspective view showing the appearance of the umbrella in the sixth embodiment according to the present invention.

FIG. 14 is a perspective view showing the appearance of the umbrella in the sixth embodiment according to the present invention.

Figure 15:
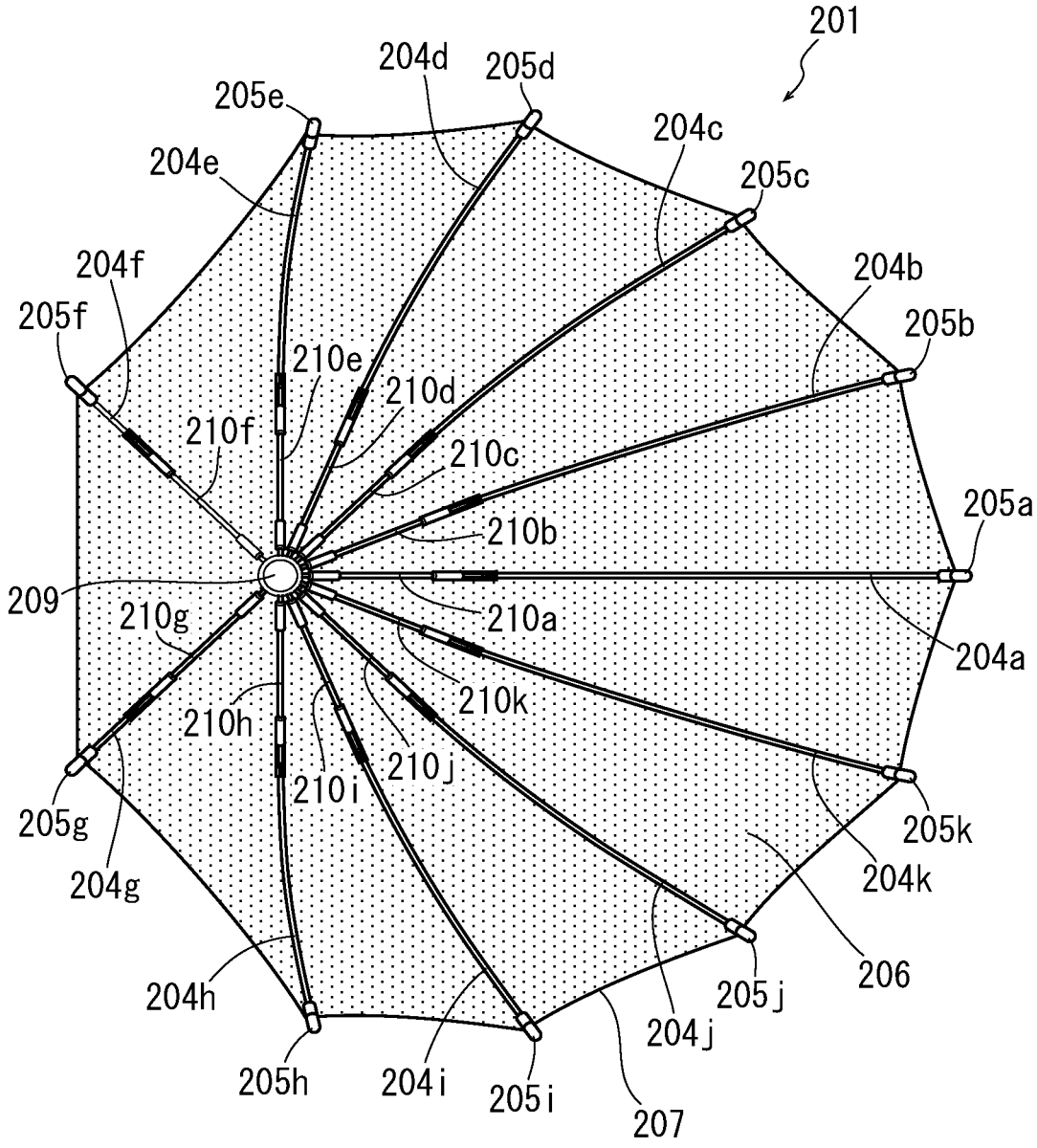
FIG. 15 is a bottom view of the umbrella 201 shown in FIG. 14 seen from the direction of handle 209.

FIG. 15 is a bottom view of the umbrella 201 shown in FIG. 14 seen from the direction of handle 209.

As shown in FIG. 14, an umbrella 201 has a ferrule 202 provided at the tip of a shaft 208 and a handle 209 is provided at the lower end of the shaft 208.

On the shaft 208, a top notch 203 is provided under a ferrule 202 and ribs 204*a*, 204*b*, 204*c*, 204*d*, 204*e*, 204*f*, 204*g*, 204*h*, 204*i*, 204*j* and 204*k* are connected to the top notch 203. A runner (not shown) is extrapolated to the shaft 208 and can move along the shaft 208. Stretchers 210*a*, 210*b*, 210*c*, 210*d*, 210*e*, 210*f*, 210*g*, 210*h*, 210*i*, 210*j* and 210*k* (shown in FIG. 15), support the ribs 204*a*, 204*b*, 204*c*, 204*d*, 204*e*, 204*f*, 204*g*, 203*h*, 204*i*, 204*j* and 204*k* and each stretcher is connected to the runner (not shown). The opening and closing of Umbrella 201 is performed by moving the runner along the shaft 208.

Tips 205*a*, 205*b*, 205*c*, 205*d*, 205*e*, 205*f*, 205*g*, 205*h*, 205*i*, 205*j* and 205*k* (refer to FIG. 15) are attached to the ribs 204*a*, 204*b*, 204*c*, 204*d*, 204*e*, 204*f*, 204*g*, 203*h*, 204*i*, 204*j* and 204*k*, respectively. The other ends of these ribs are connected to the top notch 203. These tips serve to guide the raindrops and prevent injury caused by the open tip of each rib.

The adjacent tips of the tips 205*a*~205*k* attached to the rib 204*a*~294*k* are connected with each other by a thread 207. That is, by adjusting the length of the thread 207 which connects the adjacent tips, the distance between adjacent tips can be adjusted and the form of the ribs (level of curving) to which the tips are attached can be adjusted.

As shown in FIG. 14, a cloth 206 is stretched on the ribs 204~204*k*, and its function is to provide protection from the rain and sun. The form of the ribs (degree of curving) may be adjusted by the shape of the cloth 206.

With the umbrella 201, the total number of ribs is set to eleven (11) to realize a finely expressed seashell-like shape.

For example, by providing the ribs 204*a* or 204*h* of greater stiffness, the length from the tip 205*e* to 205*h* becomes longer when the umbrella 201 is in an open state, and a wider form of the umbrella can be realized.

Figure 16:
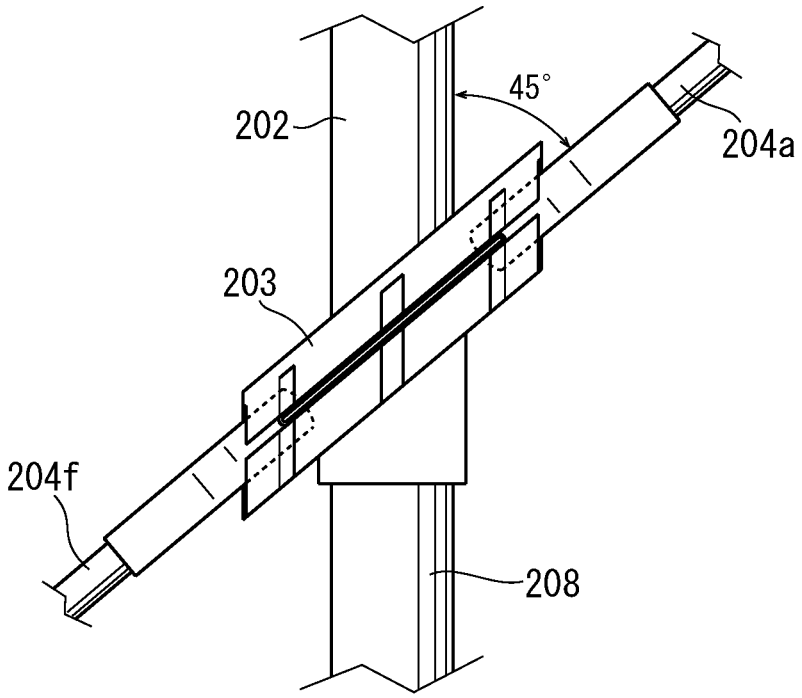
FIG. 16 is a side view of a part of the top notch 203 of the umbrella 201 as shown in FIG. 14.

FIG. 16 is a side view of a part of the top notch 203 of the umbrella 201 shown in FIG. 14 wherein only two ribs out of the plural ribs are shown for easy viewing.

In the umbrella 201 shown in FIG. 14, as shown in FIG. 16, a top notch 203 provided between a shaft 208 and a ferrule 202 is constructed such that specified ribs (rib 204*a* shown in FIG. 16) of multiple ribs are connected to the top notch 203 at vertically different positions from the connecting positions of other specified ribs (rib 204*f* shown in FIG. 16) to the top notch 203.

In the umbrella 201, the rib 204*a* the tip of which points upward, the top notch 203 and the rib 204*f* which points almost in the same direction as the rib 204*a* form a smooth line with no irregularity when the umbrella is opened. For example, the angle made between the rib 204*a* and the ferrule 202 is set to 45 degrees so that the smooth line stated above is aesthetically pleasing when the umbrella is opened.

A further embodiment of the invention will be explained.

Figure 17:
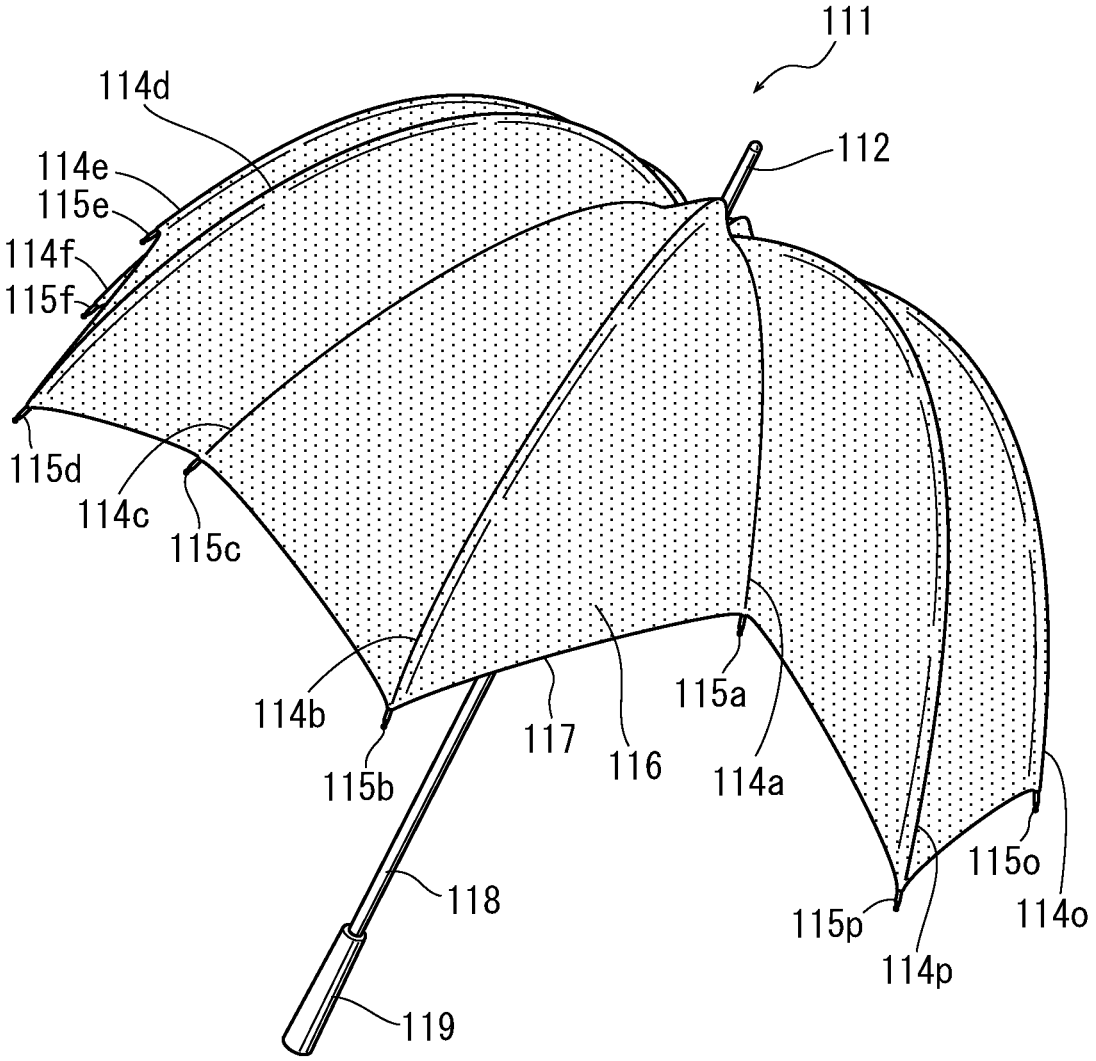
FIG. 17 is a perspective view showing the appearance of the umbrella in the seventh embodiment according to the present invention.

FIG. 17 is a perspective view showing the appearance of the umbrella in the seventh embodiment according to the present invention.

Figure 18:
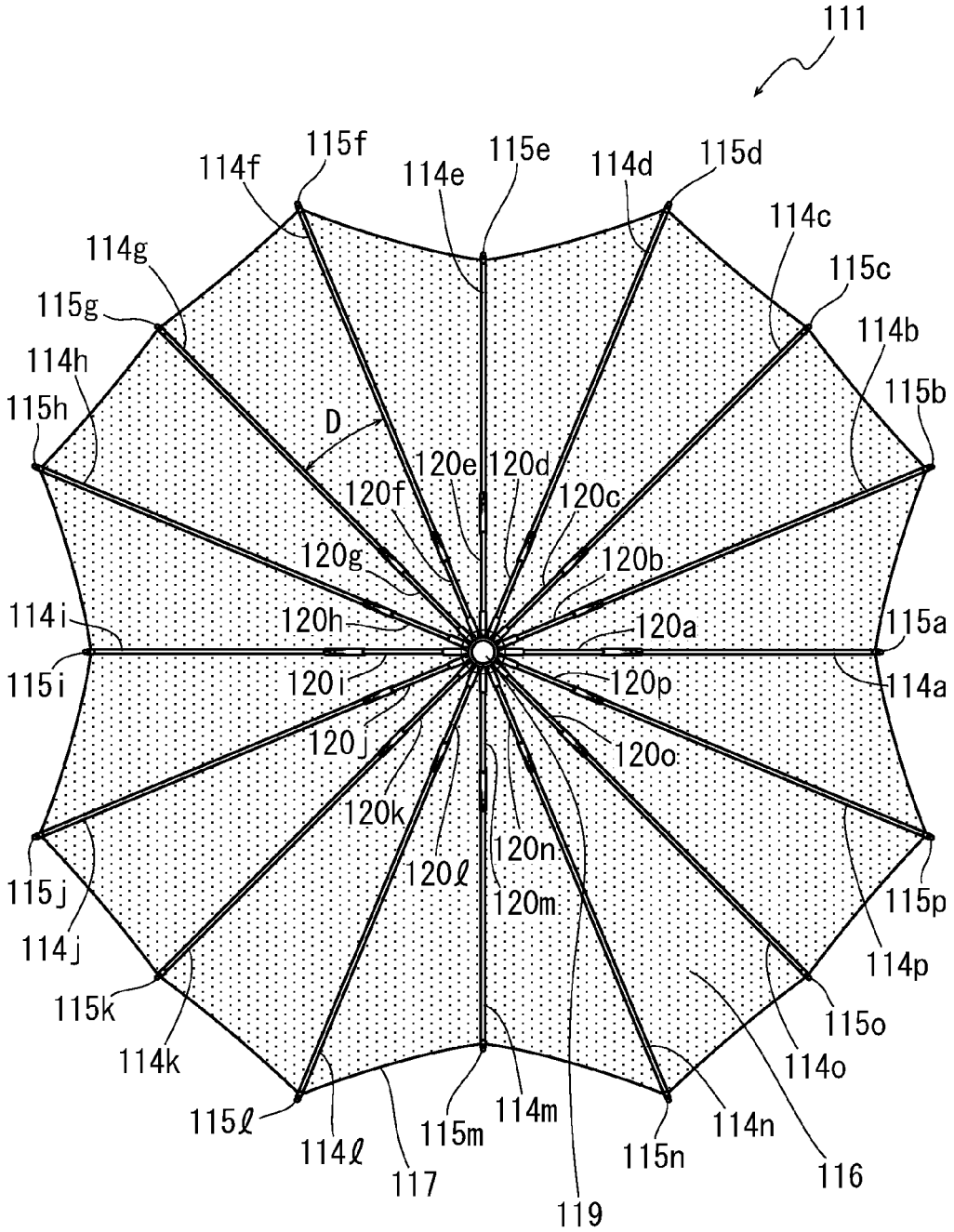
FIG. 18 is a bottom view of the umbrella 111 shown in FIG. 17 seen from the direction of the handle 119.

FIG. 18 is a bottom view of an umbrella 111 shown in FIG. 17 seen from a direction of a handle 119.

With the umbrella 111 in this embodiment, like traditional umbrellas, a ferrule 112 is provided at the tip of a shaft 118 and the handle 119 is provided at the lower end of the shaft 118.

Figure 19:
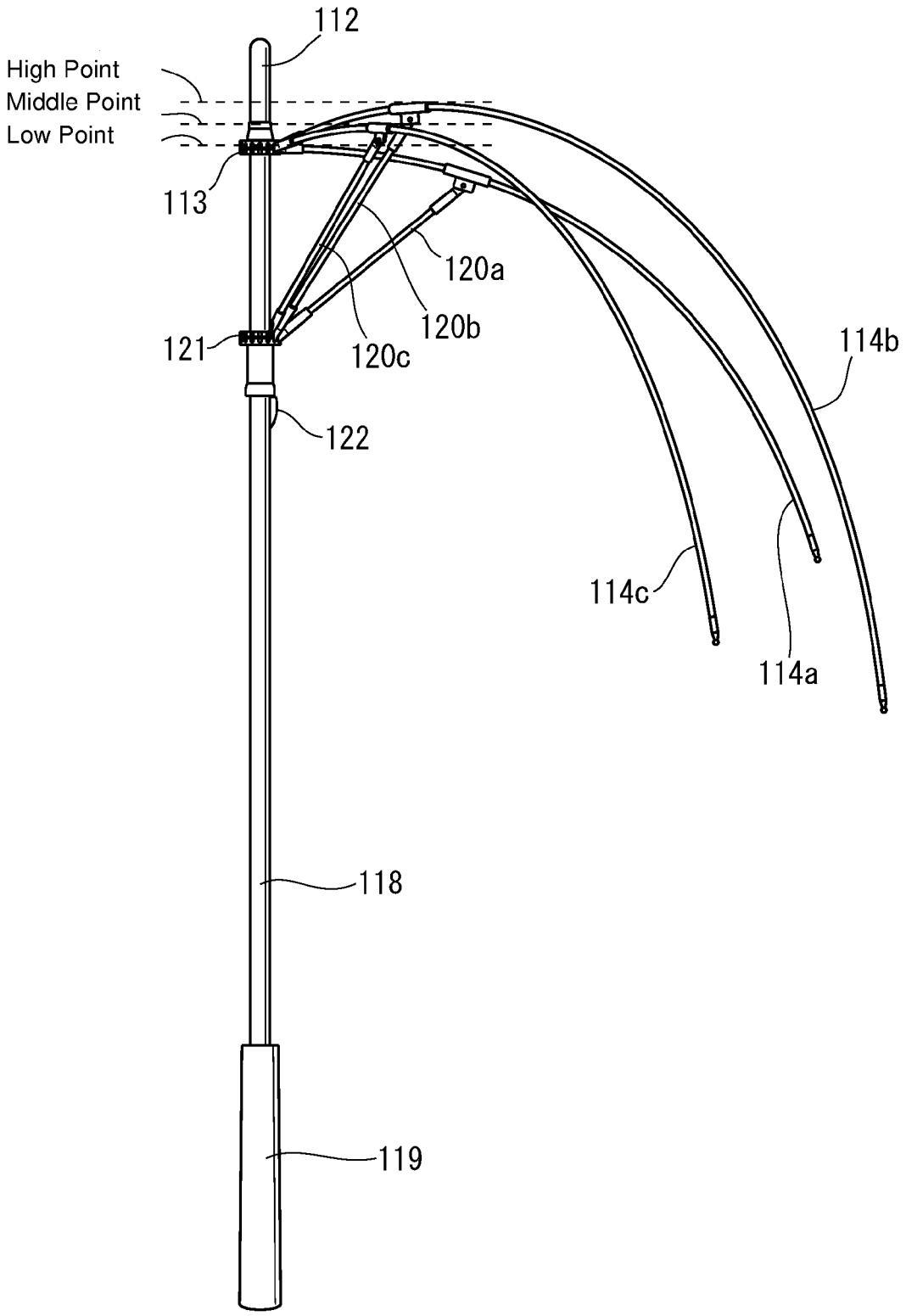
FIG. 19 is a side view of the umbrella 111 shown in FIG. 17 with thread 117, cloth 116 and superfluous ribs removed for easy viewing.

A top notch 113 is provided just under a ferrule 112 as shown in FIG. 19 and rib 114*a*, 114*b*, 114*c*, 114*d*, 114*e*, 114*f*, 114*g*, 114*h*, 114*i*, 114*j*, 114*k*, 114*l*, 114*m*, 114*n*, 114*o* and 114*p* are connected to the top notch 113 as shown in FIG. 18. As seen from FIG. 19, a runner 121 is extrapolated to the shaft 118 and can move along the shaft 118. As shown in FIG. 18, stretchers 120*a*, 120*b*, 120*c*, 120*d*, 120*e*, 120*f*, 120*g*, 120*h*, 120*i*, 120*j*, 120*k*, 120*l*, 120*m*, 120*n*, 120*o* and 120*p* which are connected to the runner 121 support the ribs 114*a*, 114*b*, 114*c*, 114*d*, 114*e*, 114*f*, 114*g*, 114*h*, 114*i*, 114*j*, 114*k*, 114*l*, 114*m*, 114*n*, 114*o* and 114*p*, respectively and the opening and closing of the umbrella 111 is performed by moving the runner 121 along the shaft 118.

The shaft 118 is provided with a top spring 122 as shown in FIG. 19 to prevent the umbrella 111 from closing when the umbrella 111 is in an open state by setting the runner 121 onto the top spring 122.

As shown in FIG. 18, tips 115*a*, 115*b*, 115*c*, 115*d*, 115*e*, 115*f*, 115*g*, 115*h*, 115*i*, 115*j*, 115*k*, 115*l*, 115*m*, 115*n*, 115*o* and 115*p* are attached to tip ends of the ribs 114*a*, 114*b*, 114*c*, 114*d*, 114*e*, 114*f*, 114*g*, 114*h*, 114*i*, 114*j*, 114*k*, 114*l*, 114*m*, 114*n*, 114*o* and 114*p*, respectively. The other ends of these ribs are connected to the top notch 113. The Tips guide the raindrops and prevent injury caused by the open tips of the respective ribs.

The adjacent tips of the tips 115*a*~115*p* are connected to each other by a thread 117.

As shown in FIG. 17, a cloth 116 is stretched on the ribs 114*a*~114*p*, and its function is to provide protection from rain and sun.

The form of the umbrella 111 may be achieved by the tension of the thread 117, by the tension of both the thread 117 and the cloth 116, or by the cloth 116 alone without the thread 117.

The umbrella 111 in this embodiment features ribs that are not equal in height when the umbrella is in an open state and seen from the side. This point will be explained below with reference to FIG. 19 and FIG. 20.

FIG. 19 is a side view of the umbrella 111 shown in FIG. 17 with the thread 117, the cloth 116 and superfluous ribs removed for easy viewing of height difference of the ribs.

Figure 20:
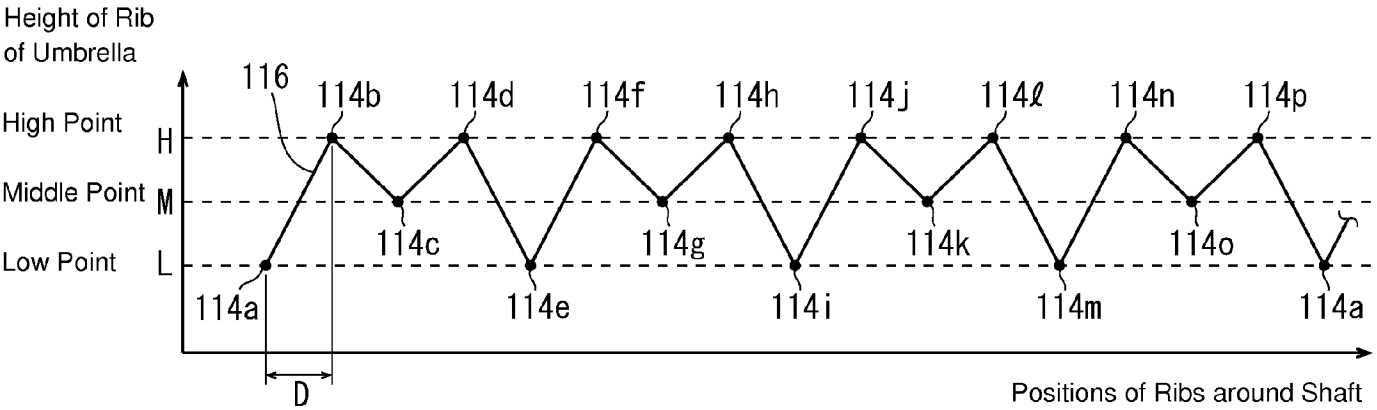
FIG. 20 is a representation of the height of the ribs of the umbrella 111 shown in FIG. 17.

FIG. 20 is a representation of height of the ribs of the umbrella 111 shown in FIG. 17 wherein an ordinate (vertical axis) represents height of ribs of the umbrella and an abscissa (horizontal axis) represents positions of the ribs developed around the shaft 118.

With the umbrella 111 shown in FIG. 19, the rib 114*b* has the highest height shown as HIGH POINT in FIG. 20, the rib 114*c* has the middle height shown as MIDDLE POINT in FIG. 20 and the rib 114*a* has the lowest height shown as LOW POINT in FIG. 20.

This form of the umbrella 111 can be realized by utilizing the technology described by referring to FIGS. 6, 8, 11 and 12.

The height of all ribs of the umbrella 111 shown in FIG. 18 is shown in FIG. 20.

In FIG. 20, D represents a distance between two adjacent ribs and the positions of the ribs are represented in terms of the distance D on the abscissa. The ribs are connected by a cloth 116 as shown in FIG. 20.

In this embodiment, the umbrella 111 is designed in such a manner that the specified ribs have vertically different heights from other specified ribs, so that a form of the umbrella like a flower petal shown in FIGS. 17 and 18 can be realized by the ribs and the cloth stretched thereon or by appropriately determining the length or flexibility of the ribs.

By utilizing the technology of varying the heights of the ribs, a variety of forms of umbrellas can be provided. Some examples of patterns of the rib heights are shown in FIG. 21~FIG. 30.

Figure 21:
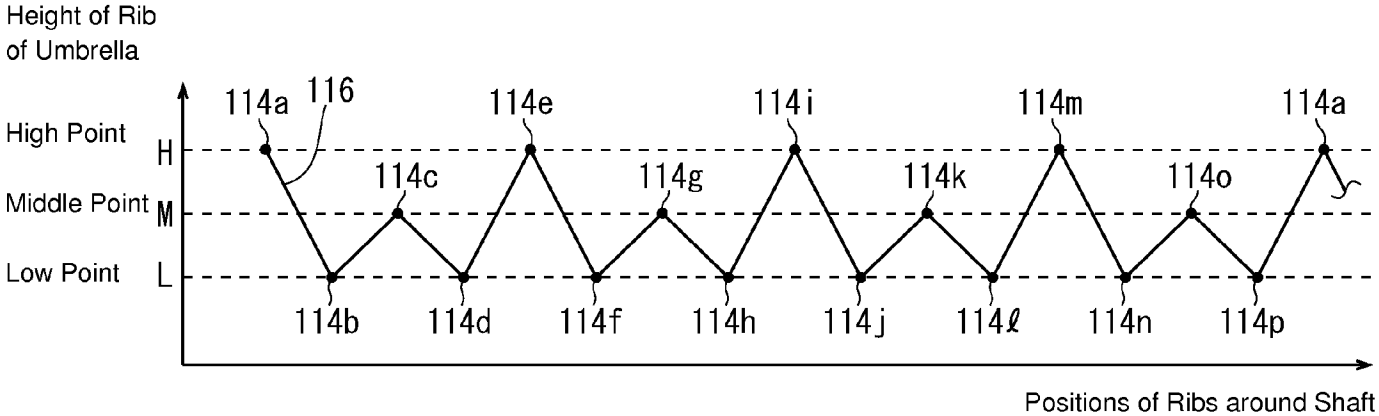
FIG. 21 is a representation of an example of the heights of the ribs of the umbrella according to the present invention.
Figure 22:
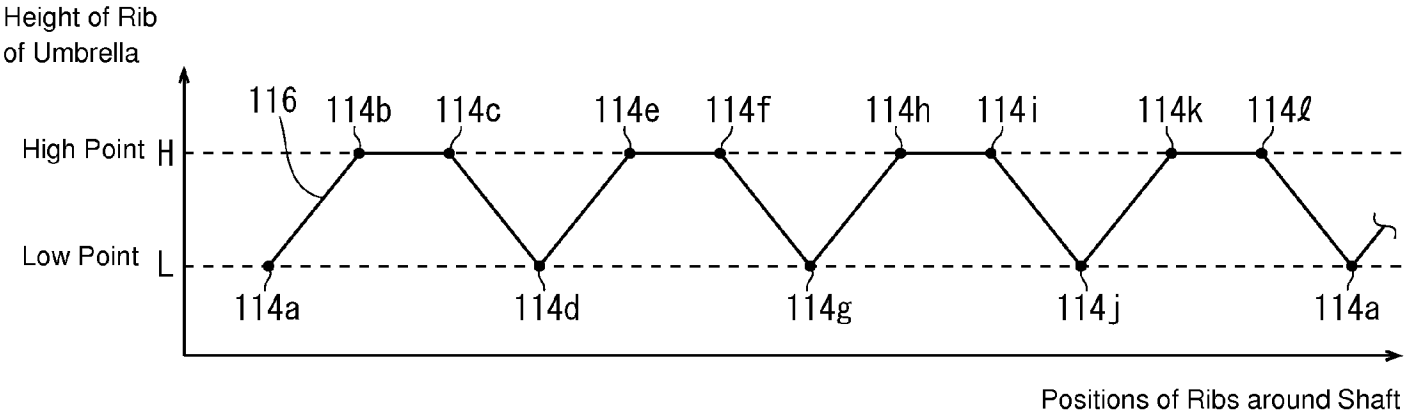
FIG. 22 is a representation of another example of the heights of the ribs of the umbrella according to the present invention.
Figure 23:
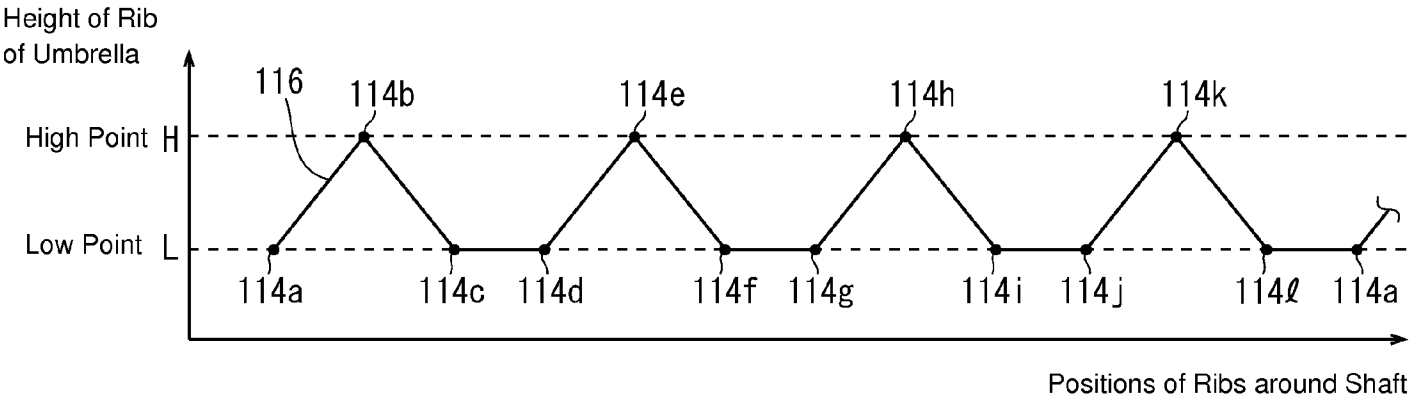
FIG. 23 is a representation of a further example of the heights of the ribs of the umbrella according to the present invention.
Figure 24:
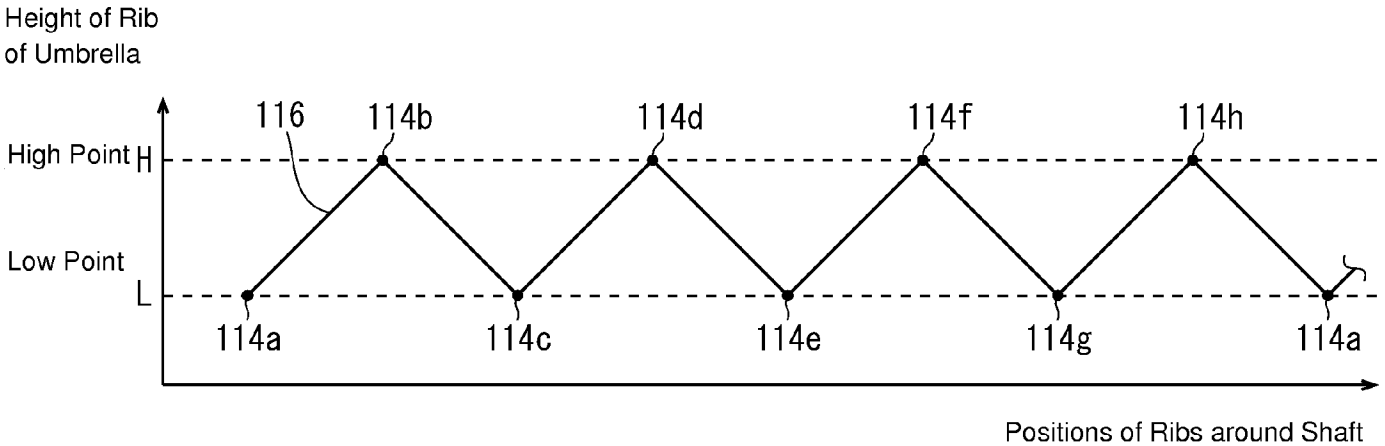
FIG. 24 is a representation of a still further example of the heights of the ribs of the umbrella according to the present invention.
Figure 25:
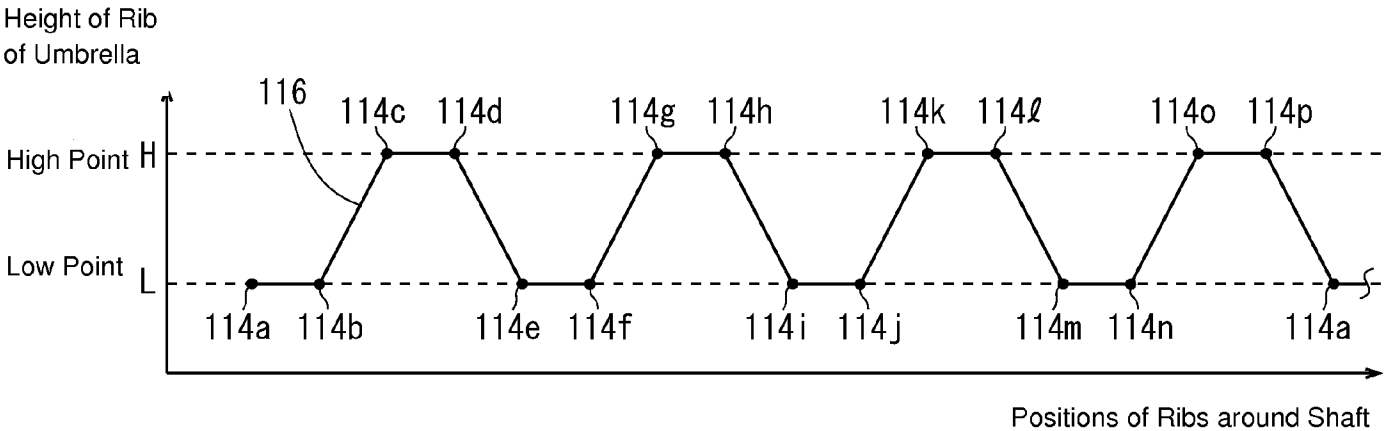
FIG. 25 is a representation of a still further example of the heights of the ribs of the umbrella according to the present invention.
Figure 26:
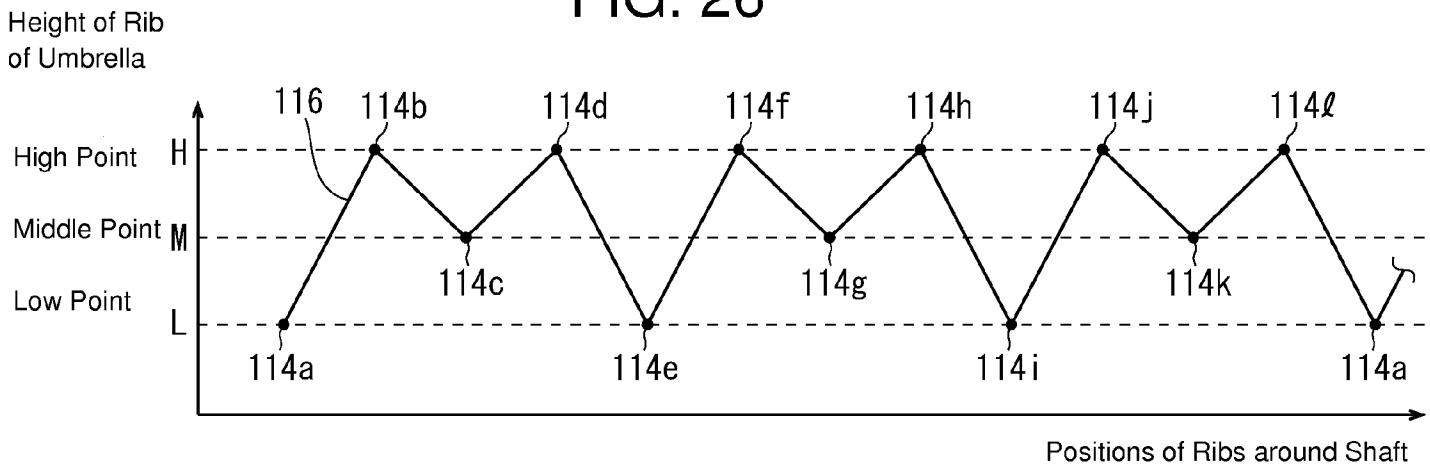
FIG. 26 is a representation of a still further example of the heights of the ribs of the umbrella according to the present invention.
Figure 27:
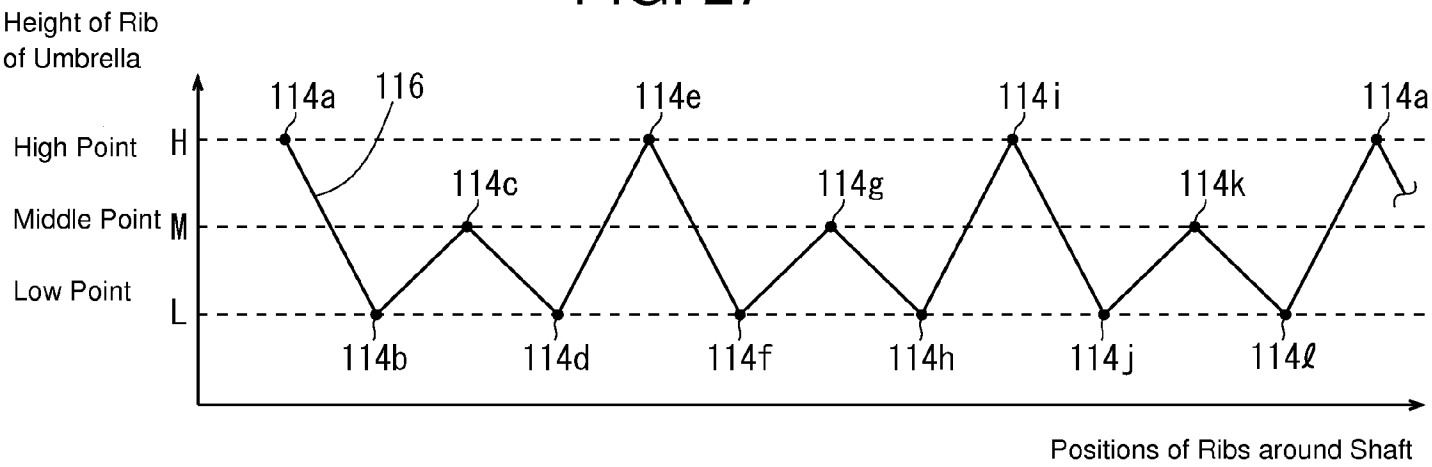
FIG. 27 is a representation of a still further example of the heights of the ribs of the umbrella according to the present invention.
Figure 28:
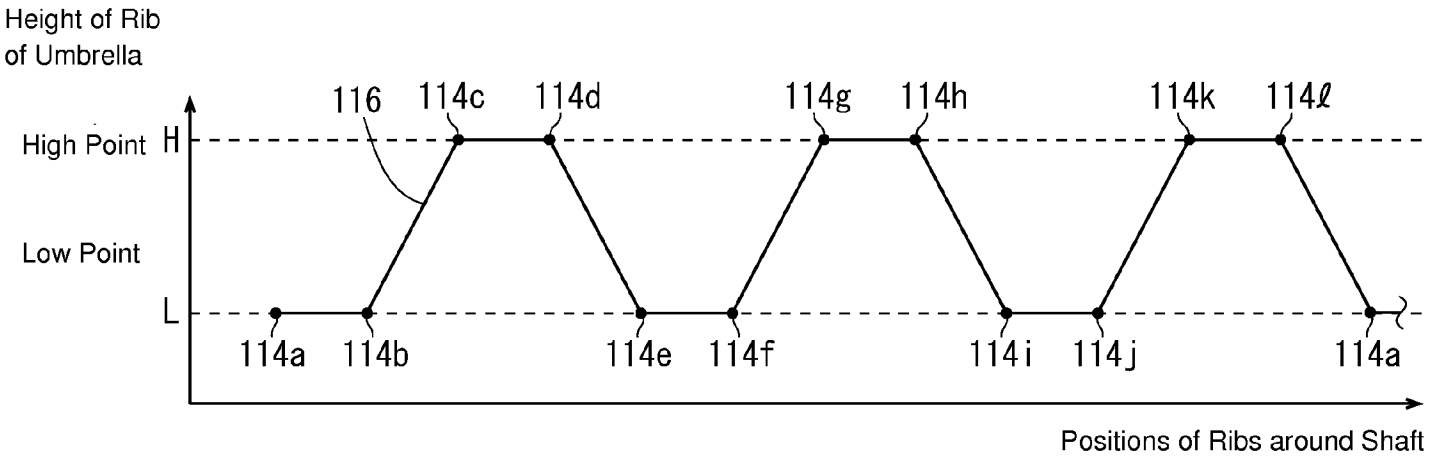
FIG. 28 is a representation of a still further example of the heights of the ribs of the umbrella according to the present invention.
Figure 29:
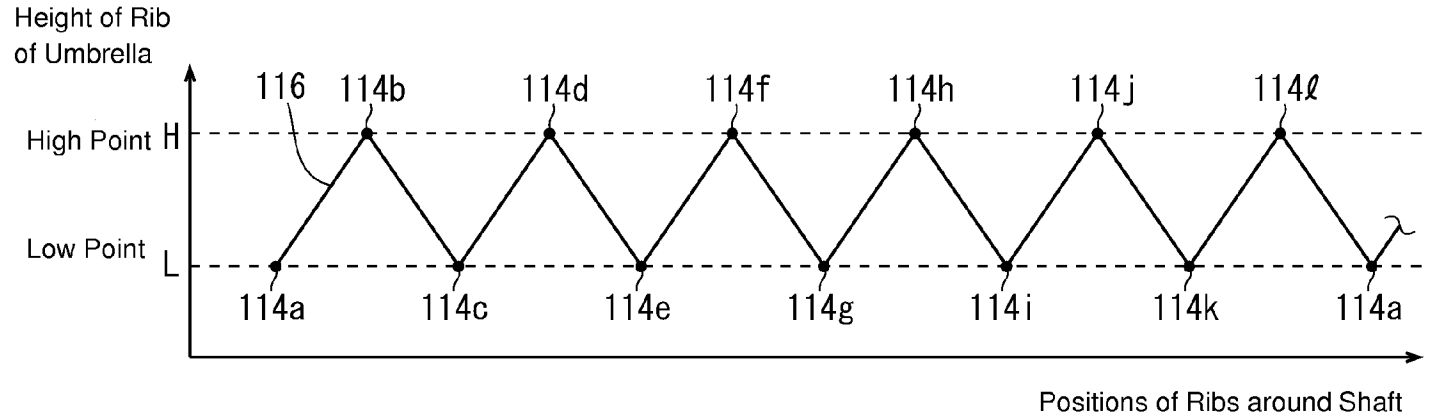
FIG. 29 is a representation of a still further example of the heights of the ribs of the umbrella according to the present invention.
Figure 30:
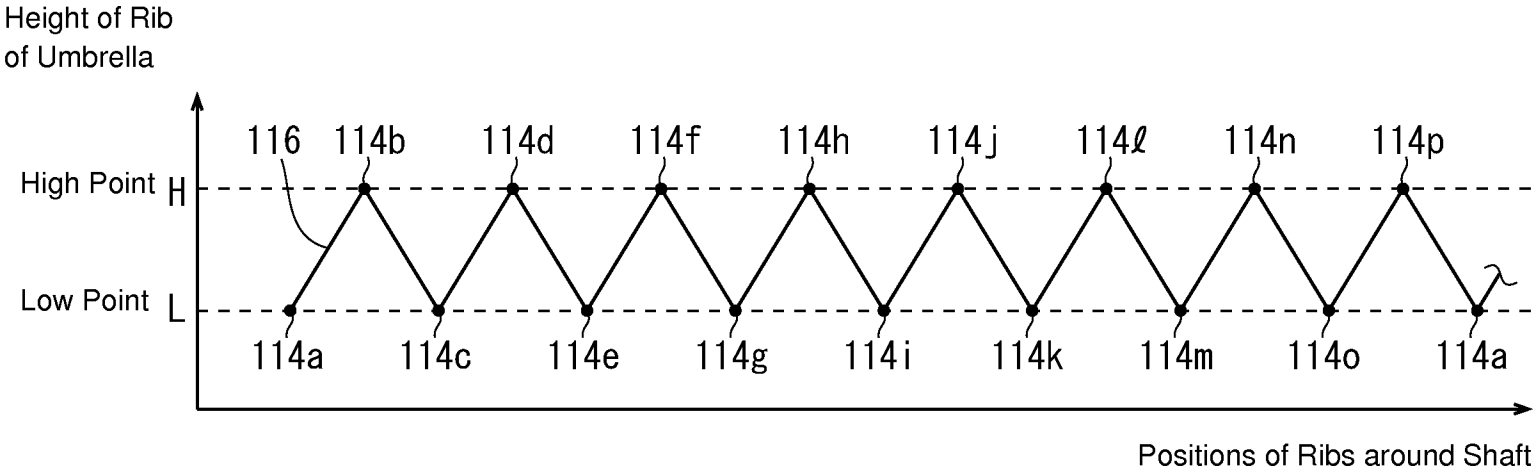
FIG. 30 is a representation of a still further example of the heights of the ribs of the umbrella according to the present invention.

FIGS. 21, 25 and 30 show examples of umbrella with 16 ribs, FIGS. 22, 23, 26, 27, 28 and 29 show examples of umbrellas with 12 ribs and FIG. 24 shows an example of an umbrella with eight (8) ribs.

Patterns of the heights of the ribs are not limited to the ones shown in these drawings, but may be of any combination of those rib heights. The number of ribs in these patterns is unlimited.

Figure 31:
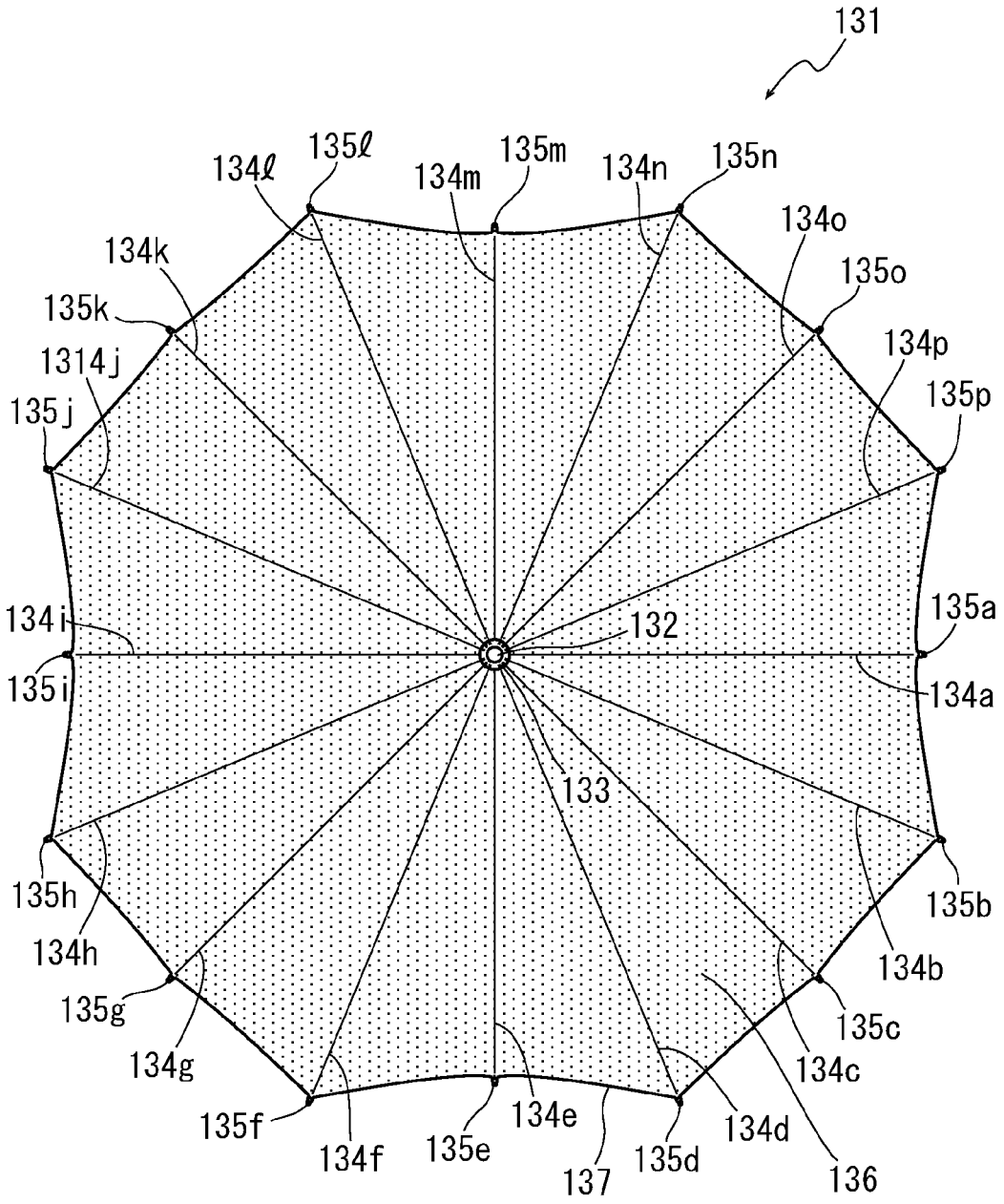
FIG. 31 is a plan view showing the umbrella in the eighth embodiment according to the present invention seen from the direction of the ferrule.

FIG. 31 is a plan view showing the umbrella in the eight embodiment according to the present invention seen from the direction of the ferrule.

The umbrella 131 in this embodiment is, like traditional umbrellas, provided with a ferrule 132 at the tip of the shaft (not shown) and with a handle (not shown) at the lower end of the shaft.

A top notch 133 is provided just under the ferrule 132, and ribs 132*a*, 134*b*, 134*c*, 134*d*,134*e*,134*f*,134*g*,134*h*, 134*i*,134*j*, 134*k*,134*l*,134*m*,134*n*,134*o* and 134*p* are connected to the top notch 133.

Tips 135*a*, 135*b*, 135*c*, 135*d*, 135*e*, 135*f*, 135*g*, 135*h*, 135*i*, 135*j*, 135*k*, 135*l*, 135*m*, 135*n*, 135*o* and 135*p* are attached to the ribs 134*a*, 134*b*, 134*c*, 134*d*, 134*e*, 134*f*, 134*g*, 134*h*, 134*i*, 134*j*, 134*k*, 134*l*, 134*m*, 134*n*, 134*o* and 134*p*, respectively. The other ends of these ribs are connected to the top notch 133. The Tips guide raindrops and prevent injury from the open tip of each rib.

The adjacent tips of these tips 135*a*~135*p* attached to the ribs 134*a*~134*p* are connected with each other by a thread 137.

A cloth 136 is put on the ribs 134*a*~134*p* for protection from the rain and sunlight. Material of the cloth 136 may be cloth, vinyl or paper. Materials with perforations such as lace or net can be used as well. Such materials can be used for either sun protection or as a fashion accessory.

As other configurations of umbrellas are similar to the umbrella 111 shown in FIG. 17, therefore a detailed explanation is omitted.

The umbrella 131 shown in FIG. 31 has an external shape formed by the thread 137 with less undulation as compared with the umbrella 111 shown in FIG. 18. In this way, umbrellas according to the present invention, can be created in a variety of forms by the thread connecting the tips and the cloth stretched on the ribs.

Figure 32:
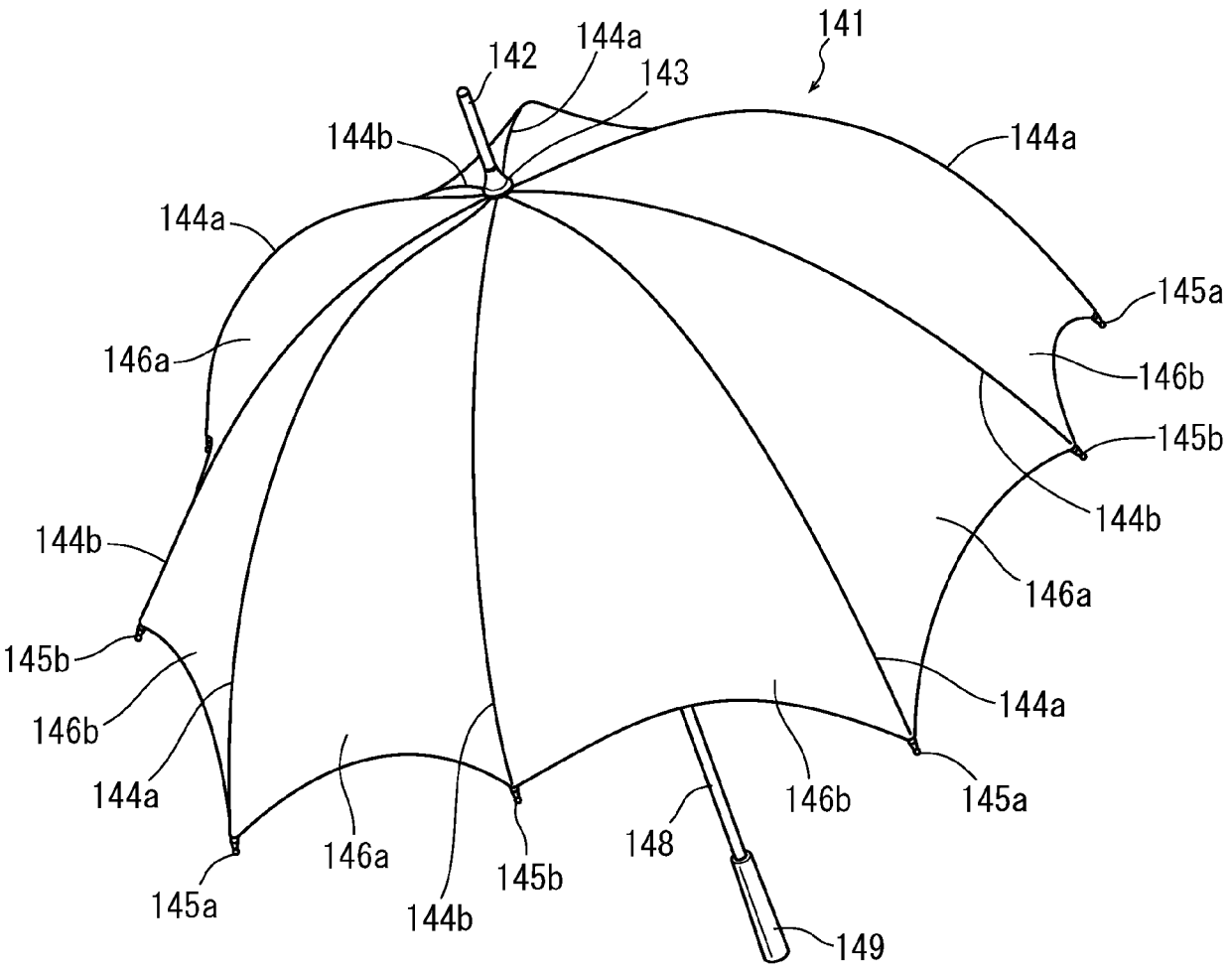
FIG. 32 is a perspective view showing the appearance of the umbrella in the ninth embodiment according to the present invention where the umbrella is opened.

FIG. 32 is a perspective view showing the appearance of the umbrella in the ninth embodiment according to the present invention where the umbrella is opened.

Figure 33:
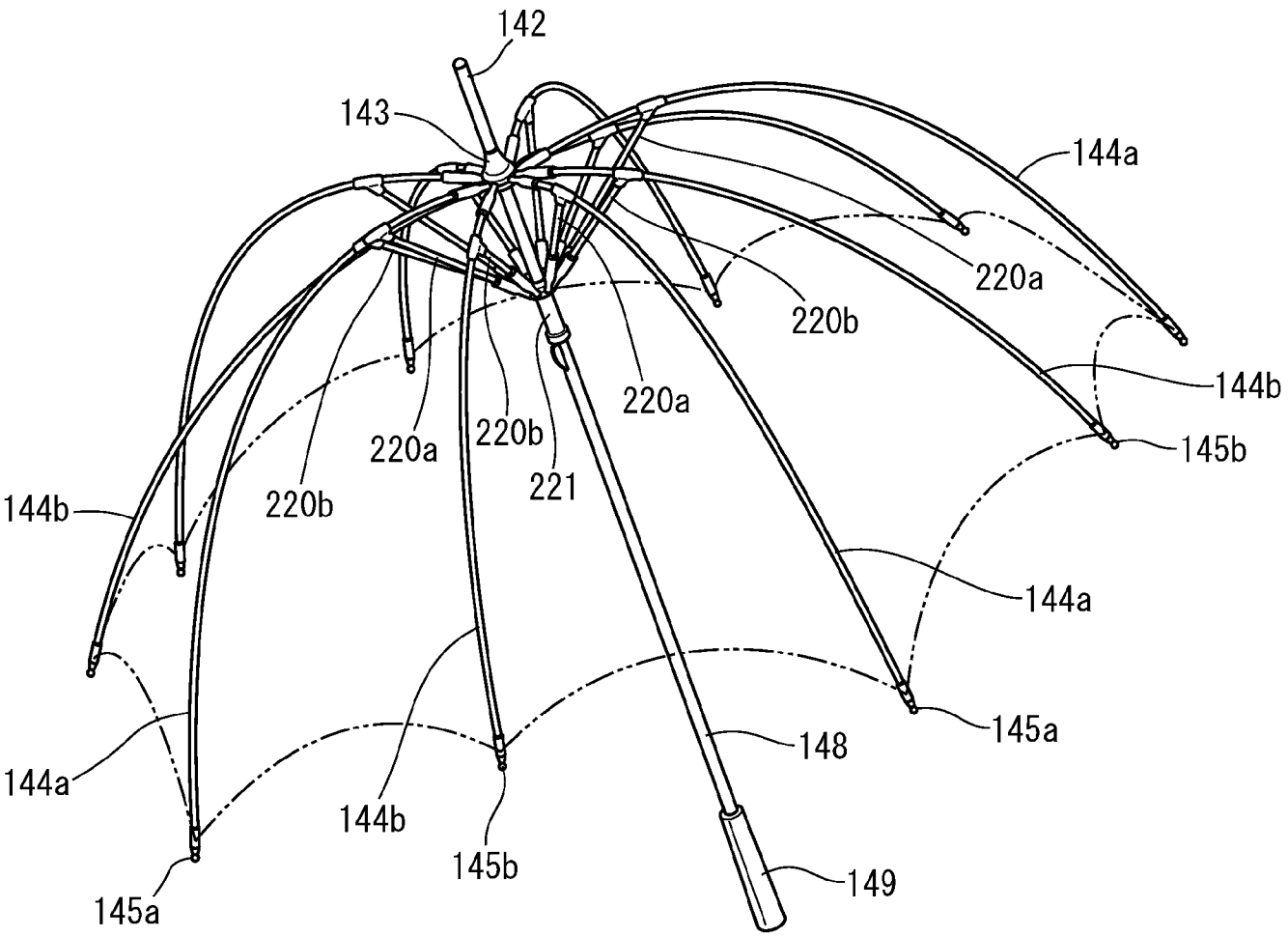
FIG. 33 is a perspective view of the umbrella 141 shown in FIG. 32 with the cloth stretched between the ribs of the umbrella 141 removed.

FIG. 33 is a perspective view showing the umbrella 141 shown in FIG. 32 with the cloth stretched between the ribs of Umbrella 141 removed.

As shown in FIGS. 32 and 33, the umbrella 141 in this embodiment is, like traditional umbrellas, provided with a ferrule 142 at the tip of the shaft 148 and with a handle 149 at the lower end of the shaft 148.

A top notch 143 is provided just under the ferrule 142 which is located at the tip of the shaft 148 and ribs 144*a* and 144*b* are connected to the top notch 143.

As seen from FIG. 33, a runner 221 is extrapolated to the shaft 148 so as to move along the shaft 148. Stretchers 220*a* and 220*b* which are connected to the runner 221 support the ribs 144*a* and 144*b*, respectively and the opening and closing of the umbrella 141 is performed by moving the runner 221 along the shaft 148.

In this embodiment, the umbrella 141 has ten ribs consisting of five ribs 144*a* and five ribs 144*b* arranged alternately. The ribs 144*a* are longer than the ribs 144*b* and the stretchers 220*a* connected with the ribs 144*a* are longer than the stretchers 220*b* connected with the ribs 144*b*.

Tips 145*a* and 145*b* are attached to the ends of the ribs 144*a* and 144*b* respectively which are opposite to the ends to the top notch 143. These tips guide the raindrops and prevent injury caused by the open tips of the respective ribs.

A cloth 146*a* is stretched between the ribs 144*a* and the rib 144*b* located right to the rib 144*a*. A cloth 146*b* is stretched between the rib 144*b* and another rib 144*a* located right to the rib 144*a*. By adjusting the forms or qualities of the material of the cloth 146*a* and 146*b* stretched between adjacent ribs, the distance between the ribs and the forms of the ribs can be adjusted when the umbrella is opened.

Figure 34:
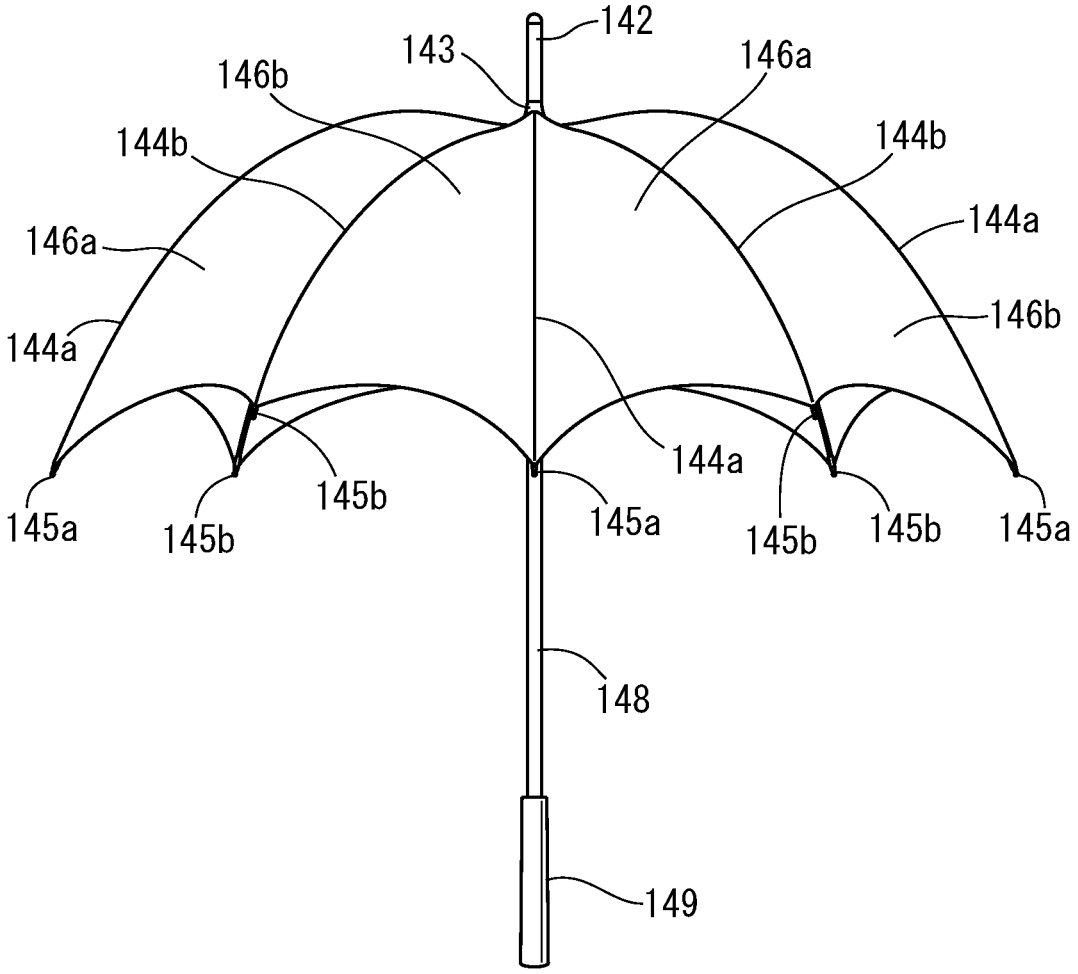
FIG. 34 is a front view of the umbrella 141 shown in FIG. 32.

FIG. 34 is a side view of the umbrella 141 shown in FIG. 32.

With the umbrella 141 in this embodiment, the stretchers 220*a* and 220*b* become almost parallel to the shaft 148 when the umbrella is closed. As the long stretcher 220*a* is connected with the long rib 144*a* and the short stretcher 220*b* is connected with the short rib 144*b*, the long rib 144*a* is lifted in a higher position by the long stretcher 220*a* and the short rib 144*b* is lifted in a lower position by the short stretcher 220*b* when the umbrella is opened. Therefore, as shown in FIG. 34, when the umbrella is seen from its side, the long rib 144*a* is lifted very high by the long stretcher 220*a* and the short rib 144*b* is lifted in a lower position by the short stretcher 220*b* resulting in undulating shapes in the forms of the cloth 146*a* and 146*b*.

Figure 35:
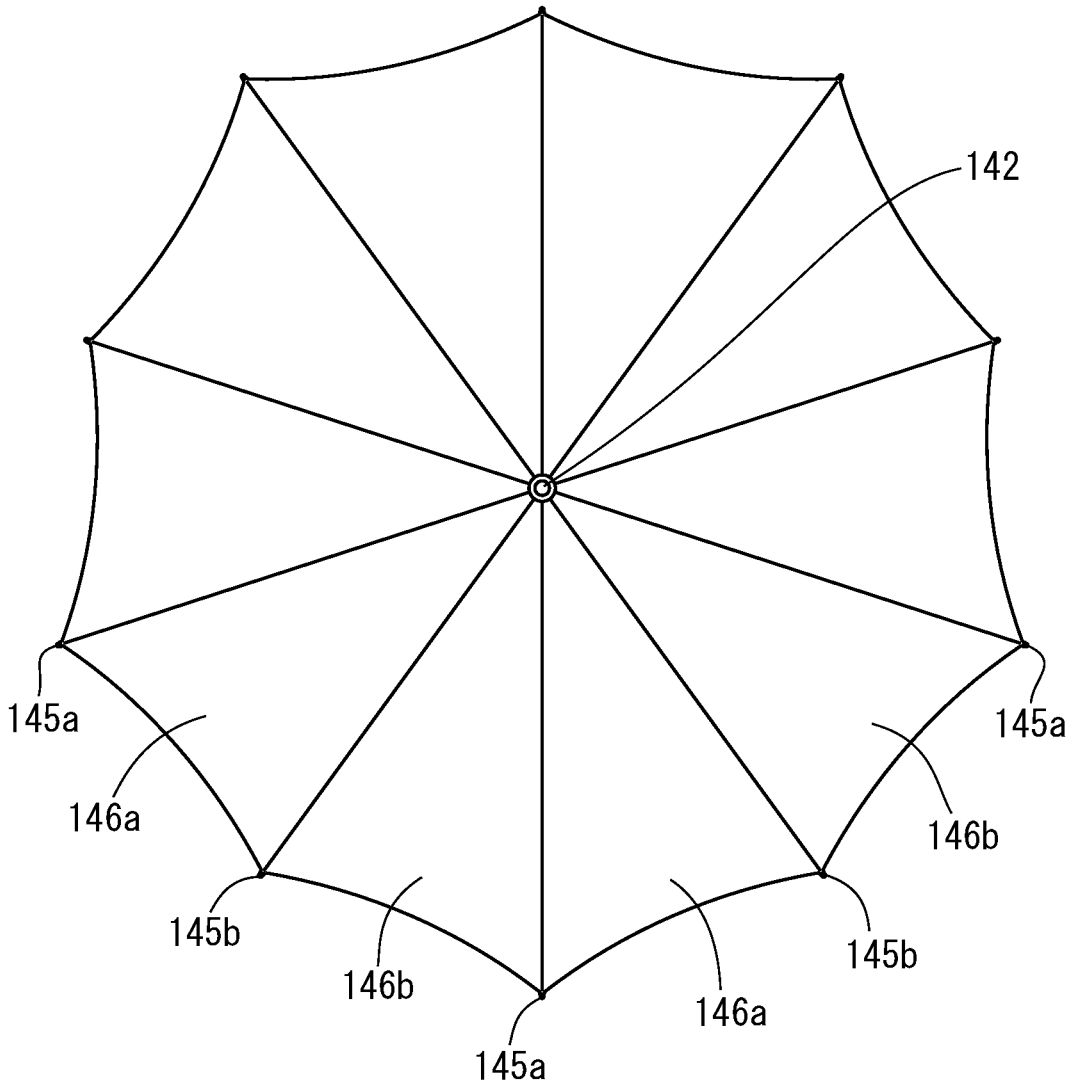
FIG. 35 is a plan view showing the umbrella 141 shown in FIG. 32.

FIG. 35 is a plan view of the umbrella 141 shown in FIG. 32.

Figure 36:
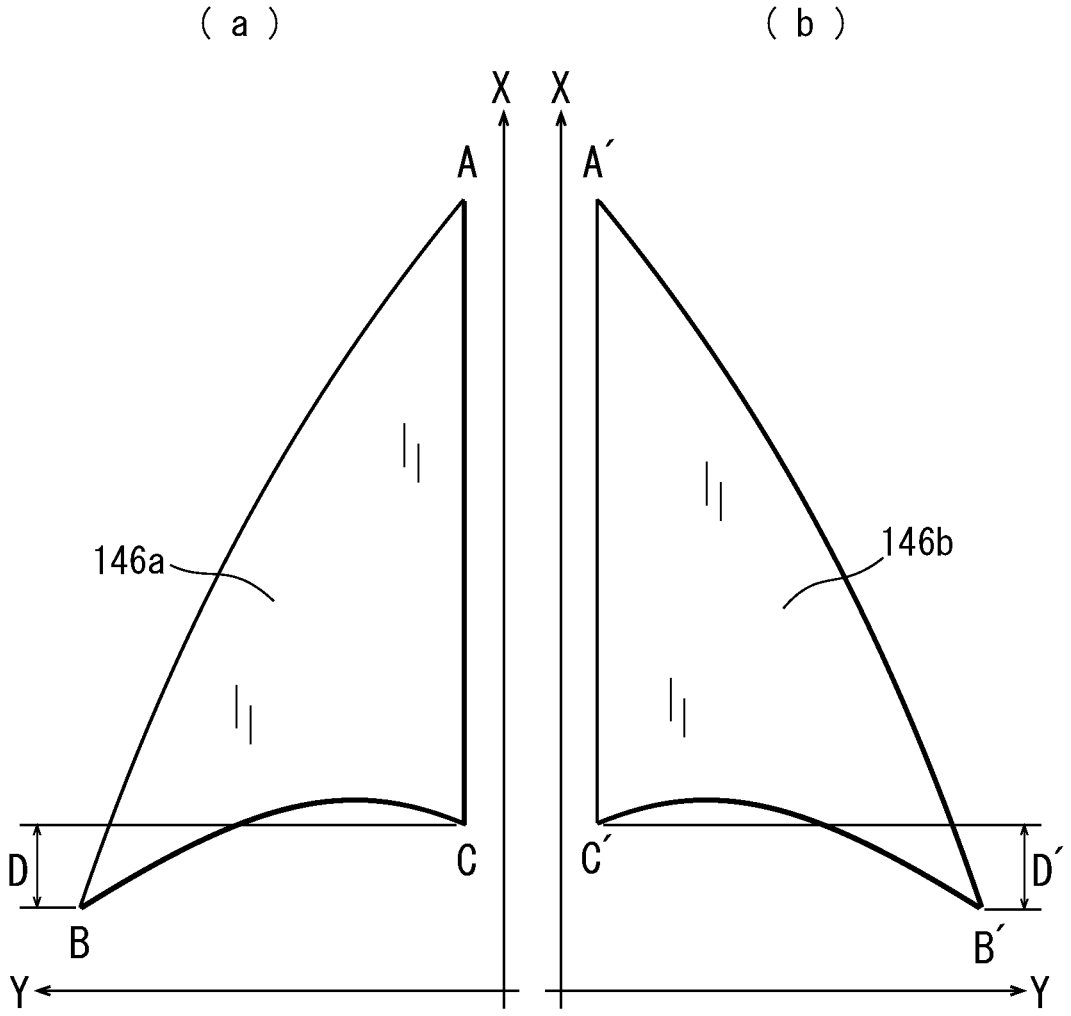
FIG. 36 is a plan view of the cloth of the umbrella 141 shown in FIG. 32 wherein (a) is a plan view of the cloth 146*a* and (b) is a plan view of the cloth 146*b*.

FIG. 36 is a plan view showing the cloth of the umbrella 141 shown in FIG. 32 wherein (a) is a plan view of the cloth 146*a* and (b) is a plan view of the cloth 146*b*.

The umbrella 141 in this embodiment is characterized by the cloth stretched between the ribs.

The cloth 146*a* shown in FIG. 36(*a*) is stretched between the rib 144*a* and the rib 144*b* located right of the rib 144*a*. The edge of the cloth 146*a* from Point A to Point B is located on the rib 144*a*, and the edge of the cloth 146*a* from Point A to Point C of is located at the same position of the rib 144*b*.

The cloth 146*b* shown in FIG. 36 (*b*) is stretched between the rib 144*b* and the rib 144*a*. The rib 144*b* is located to the right of rib 144*a*. The edge of the cloth 146*b* from Point A' to Point C' is located on the rib 144*b* and the edge of the cloth 146*b* from Point A' to Point B' is located on the rib 144*a*.

It is to be noted that the material of the cloth 146*a* is not expandable and contractible or elastic in the direction of X-axis (which is parallel to the side between Point A and Point C of the cloth 146*a*), but it is expandable and contractible in the direction of Y-axis (which is perpendicular to the side between Point A and Point C of the cloth 146*a*). The cloth 146*a* may be not only expandable and contractible in the direction of Y-axis, but also expandable and contractible in any other direction except for the direction parallel to the side between Point A and Point C of the cloth 146*a*. In this embodiment, Point C and Point B are separated by the distance of D in the direction of X-axis.

The cloth 146*a* may be not expandable and contractible in the direction of length of the rib 144*a* or the rib 144*b*, but expandable and contractible in any other direction than the direction of length of the ribs 144*a* and 144*b* when the cloth 146*a* is stretched between these ribs 144*a* and 144*b*.

It is also to be noted that the material of the cloth 146*b* is not expandable and contractible or elastic in the direction of X-axis (which is parallel to the side between Point A' and Point C' of the cloth 146*b*), but expandable and contractible in the direction of Y-axis (which is perpendicular to the side between Point A' and Point C' of the cloth 146*b*). The cloth 146*b* may be not only expandable and contractible in the direction of Y-axis, but also expandable and contractible in any other direction except for the direction parallel to the side between Point A' and Point C' of the cloth 146*b*. In this embodiment, Point C' and Point B' are separated by the distance of D in the direction of X-axis.

The cloth 146*b* may be not expandable and contractible in the direction of length of the rib 144*a* or the rib 144*b*, but expandable and contractible in any other direction than the direction of length of the ribs 144*a* and 144*b* when the cloth 146*a* is stretched between these ribs 144*a* and 144*b*.

Material of the cloth 146*a* and 146*b* may be polyester, nylon and etc, and it is possible to decide level of expansion and contraction of the cloth by selecting the direction of the cut of the cloth.

In this embodiment, beautiful forms of the umbrella as shown in FIGS. 32 and 34 can be achieved by stretching the cloth 146*a* and 146*b* between the ribs 144*a* and 144*b*, when the umbrella 141 is opened.

Features of the invention have been explained in various embodiments described above. It is needless to say that any of the features taken out or combined as needed could still constitute the invention.

The embodiments described above may be modified such that length of the ribs, angle made by the ribs, level or direction of curving of the ribs are adjusted as desired to form desired shape of the umbrellas by the rib structure. Many variations may also be made within the same aspect.

Since this invention can be realized by the rib structure of the umbrella as described above, for example, the shaft of the umbrella does not influence the consummation or enforcement of the invention. It is also to be noted that the invention is applicable not only to umbrellas, but also to anything which has umbrella ribs such as for example buildings/structures (especially clothing companies, restaurants or cafés which can expect an increase of customers due to an aesthetic appearance), shading and rain cover parts for baby carriages or other vehicles, beach parasols, beach umbrellas or lamp shades. It is also applicable to mosquito nets and insect repellent nets designed to repel insects.

Also, the rib structure of the umbrella according to this invention may be applied to umbrellas for animals such as dogs and cats. Parabolic antennas and hand fans that use the form created by this invention can be produced.

In addition, according to the rib structure of the umbrella of this invention, we can also produce forms of leaves of plants such as a maple leaf and can provide superior forms from an aesthetic stand point.

Although umbrellas involve an opening and closing operation, the rib structure of this invention does not necessarily involve an opening and closing operation and can apply to items which are always in an open state.

According to the rib structure of the umbrella in this invention, various forms of rib structures for fashionable umbrellas as described above can be produced. In regards to the forms, for example, we can provide the form of a shell by using ribs of the umbrella and cloth stretched on it. Beyond that, we can create various geometric patterns such as forms of leaves, such as a maple leaf and forms of flowers as well as snow crystals.

As explained, according to this invention, we can produce umbrellas which can contribute to the development of the industry by getting consumers motivated to buy umbrellas which have a superior aesthetic appearance. This is done without creating unnecessary structural pressure on the umbrella.

That is, according to this invention, we have made a form available which can be formed by each of the ribs, by connecting tips of the umbrella with thread and therefore creating desired forms that can be easily realized.

Also, with the rib structure of the umbrella formed by multiple ribs, we can stretch cloth onto these multiple ribs. We change the form of the cloth stretched on said ribs, to achieve desired forms that can be easily realized.

Also, the angle between adjacent ribs of the umbrella is varied by using specified ribs. Therefore enabling the production of various forms, such as a shell, by using a combination of ribs of the umbrella and the cloth stretched onto it. Also, by removing some of the ribs from traditional umbrellas, a variety of structures can be made by using different angles of adjacent specified ribs.

In addition, according to this embodiment, the length of a specified rib among multiple ribs is different from other specified ribs. Therefore, it has the effect of producing various forms such as a shell by using a combination of ribs of the umbrella and the cloth stretched onto it.

According to this embodiment, we changed of the length of the specified stretcher among other stretchers connected to the ribs. Therefore the umbrella does not receive unnecessary structural pressure and can be protected from breakage.

Also, we made available a change to the length of the stretcher connected to the ribs according to the length of the rib, therefore the umbrella does not receive unnecessary structural pressure and it can be protected from breakage.

Also, according to this embodiment, we made specified stretchers, which slide into other cylinder-like stretchers, so that the length of the stretcher changes according to the operation of opening and closing the umbrella. Therefore, the umbrella does not receive unnecessary structural pressure and it can be protected from breakage.

Also, according to this invention, we expanded the operational range of specified ribs at the point where the ribs are connected with the top notch, and expanded the operational range of specified stretchers at the point where the stretchers are connected with the runner. Therefore, the umbrella does not receive unnecessary structural pressure and it can be protected from breakage. The opening and closing operation can be done smoothly, and desired forms can be created by the ribs. Also, the operational range of each rib can be easily expanded by cutting specified parts of the traditional umbrella top notch or runner.

Also, according to this invention, we varied the length of the stretchers, which connect with the ribs, and varied the connecting position of the ribs and stretchers and adjusted them accordingly. Therefore, the umbrella does not receive unnecessary structural pressure and can be protected from breakage. Desired forms can be realized with these ribs.

Also, according to this invention, we varied the length of stretchers, which are connected with the ribs, in accordance with the length of the ribs, and varied the connecting position to the ribs and stretchers and adjusted them accordingly. Therefore, the umbrella does not receive unnecessary structural pressure and can be protected from breakage. Desired forms can be realized with these ribs.

Also, according to this invention, we connected multiple ribs to the top notch. Specified ribs among these multiple ribs are connected facing a direction that is not toward the center of the top notch. Multiple ribs are connected at one of their ends with the top notch. Therefore, desired forms can be realized with these ribs.

Also, according to this invention, we connected multiple stretchers to the runner. Specified stretchers among these multiple stretchers are connected facing a direction that is not toward the center of the runner. Multiple stretchers are connected at one of their ends with the runner. Therefore, desired forms can be realized with these ribs.

Also, according to this invention, multiple ribs were connected with their ends attached to the top notch, and we made the connecting position of the specified ribs among multiple ribs different from the connecting position of other specified ribs in the vertical direction. Therefore, desired forms can be created by the ribs.

Also, according to this invention, multiple ribs are connected to the top notch and lift other ends of multiple ribs when it opens, the umbrella does not receive unnecessary structural pressure, thus preventing it from breakage. Desired forms can be realized with these ribs.

Also, according to this invention, the umbrella was created by stretching cloth onto the above mentioned multiple ribs. Desired forms can be created by the cloth stretched onto the ribs.

Also, according to this invention, when the umbrella is opened, specified ribs among multiple ribs curve in a direction that is different from the direction the rib moves in with regards to the opening and closing operation. Therefore, desired forms can be created by the ribs.

Also, according to this invention, we made the level of flexibility of specified ribs among multiple ribs different from the level of flexibility of other specified ribs. Therefore, desired forms can be created by these ribs.

Also, according to this invention, when the umbrella is opened and seen from the side, we made the height of specified ribs different from the height of other specified ribs. Therefore, desired forms can be created by these ribs.

As mentioned previously, the embodiments described above are to realize an aesthetic improvement of form of the appearance of umbrellas, however, this invention is not limited to this. For example, it can be applied not only to umbrellas or parasols, but also to buildings, structures (especially, clothing companies, restaurants and cafés which can expect an increase of customers due to an improved aesthetic appearance), shading and rain cover parts for baby carriages or other vehicles, beach parasols, beach umbrellas or lamp shades. Also, it can be applied to mosquito nets and insect repellent nets.

Also, the rib structure of the umbrella with this invention may be applied to umbrellas for animals, such as dogs and cats. Forms of Parabolic antennas and Hand Fans can be made by this invention as well.

In addition, according to the rib structure of the umbrella of this invention, we can produce forms of leaves of plants, such as a maple leaf, and can provide superior forms from an aesthetic stand point.

Although umbrellas involve an opening and closing operation, the rib structure of this invention does not necessarily involve an opening and closing operation and can apply to items which are always in an open state.

According to this invention, we can produce aesthetic forms as described above. Therefore, we can expect an increase in the motivation of customers to buy and thus we can contribute the development of the industry.

The embodiments described above are to realize an aesthetic improvement of appearance, however, this invention is not limited to it. For example, it can be applied not only to umbrellas or parasols, but also to buildings, structures (especially clothing companies, restaurants and cafés which can be expect an increase of customers due to an improved aesthetic appearance), shading and rain cover parts for baby carriages or other vehicles, beach parasols, beach umbrellas and lamp shades. Also, it can be applied to mosquito nets and insect repellent nets.

What is claimed is:

1. An umbrella comprising:

a plurality of ribs comprising first ribs having a first rib length and second ribs having a second rib length shorter than the first rib length, wherein the first ribs and the second ribs are arranged around a shaft in a first pattern of alternating lengths;

a plurality of stretchers arranged around the shaft, the plurality of stretchers comprising first stretchers having a first stretcher length and second stretchers having a second stretcher length shorter than the first stretcher length, wherein each of the first stretchers is attached to a respective one of the first ribs, wherein each of the second stretchers is attached to a respective one of the second ribs; and cloth attached to and disposed between the ribs;

wherein the rib structure has an open state and a closed state, wherein in the open state, the first ribs, the first stretchers, the second ribs, and the second stretchers create a form having a second pattern of alternating heights that alternates between a first vertical height and a second vertical height lower than the first vertical height, and wherein each of the first ribs is between two of the second ribs and has the first vertical height, and each of the second ribs is between two of the first ribs and has the second vertical height, wherein portions of the cloth disposed between a first rib and a second rib are not expandable and contractible in a first direction associated with a length of the second rib, but are expandable and contractible in a second direction perpendicular to the first direction.

2. The umbrella according to claim 1, wherein a first range of movement in a vertical direction of the first ribs is larger than a second range of movement of the second ribs.

3. The umbrella according to claim 1, wherein each of the first stretchers and each of the second stretchers is connected to a corresponding rib and to a runner disposed on the shaft.

4. An umbrella comprising:

a shaft;

a rib structure comprising a plurality of ribs, the rib structure comprising first ribs having a first rib length and second ribs having a second rib length smaller than the first rib length, the first and second ribs arranged around the shaft in a first pattern of alternating lengths formed by alternating between the first ribs and the second ribs;

a plurality of stretchers arranged around the shaft, the plurality of stretchers comprising first stretchers having a first stretcher length and second stretchers having a second stretcher length shorter than the first stretcher length, wherein each of the first stretchers is attached to a respective one of the first ribs, wherein each of the second stretchers is attached to a respective one of the second ribs; and a cloth spanning the rib structure, the cloth being expandable and contractible across the rib structure as the umbrella is moved between an open and a closed orientation, wherein portions of the cloth disposed between a first rib and a second rib are not expandable and contractible in a first direction associated with a length of the second rib, but are expandable and contractible in a second direction perpendicular to the first direction, wherein when the umbrella is in the open orientation, the rib structure and the plurality of stretchers create a form having a second pattern of alternating heights that alternates between a first vertical height associated with the first ribs and a second vertical height associated with the second ribs, wherein each of the first ribs is between two of the second ribs and each of the second ribs is between two of the first ribs.

5. The umbrella of claim 4 wherein the central shaft comprises an upper end and a notch at the upper end, wherein an end of each of the plurality of ribs is connected to the notch.

6. The umbrella of claim 5, wherein each of the plurality of stretchers connects a respective one of the plurality of ribs to the shaft.

7. The umbrella of claim 4, wherein the cloth is attached to the ribs.

8. An umbrella comprising:

a central shaft;

a plurality of ribs attached to an upper end of the central shaft; and a cloth covering said plurality of ribs, wherein the plurality of ribs comprises first ribs having a first rib length and a first rib height, and second ribs having a second rib length shorter than the first rib length and a second rib height lower than the first rib height, wherein the first ribs and the second ribs are arranged around the central shaft in a first alternating pattern that alternates between first ribs and second ribs, thereby creating a second alternating pattern that alternates between first rib heights and second rib heights when the umbrella is opened, wherein portions of the cloth disposed between a first rib and a second rib are not expandable and contractible in a first direction associated with a length of the second rib, but are expandable and contractible in a second direction perpendicular to the first direction.

9. The umbrella of claim 8, further comprising a plurality of stretchers extending between the plurality of ribs and the central shaft so that movement of the stretchers extends the ribs and opens the umbrella.

10. The umbrella of claim 9, wherein the stretchers are of a plurality of lengths, with longer stretchers being associated with longer ribs.

11. The umbrella of claim 10, wherein the cloth is attached to the ribs.

* * * * *